US006452556B1

(12) United States Patent
Ha et al.

(10) Patent No.: US 6,452,556 B1
(45) Date of Patent: Sep. 17, 2002

(54) BUILT-IN DUAL BAND ANTENNA DEVICE AND OPERATING METHOD THEREOF IN A MOBILE TERMINAL

(75) Inventors: Dong-In Ha, Seoul (KR); Wan-Jin Choi, Kyonggi-do (KR); Dong-Hwan Kim, Seoul (KR); Jun-Kyu Kang, Seoul (KR)

(73) Assignee: Samsung Electronics, Co., Ltd. (KR)

( * ) Notice: Subject to any disclaimer, the term of this patent is extended or adjusted under 35 U.S.C. 154(b) by 0 days.

(21) Appl. No.: 09/956,654

(22) Filed: Sep. 20, 2001

(30) Foreign Application Priority Data

Sep. 20, 2000 (KR) ..... 00-55275

(51) Int. Cl.[7] ..... H01Q 1/24

(52) U.S. Cl. ..... 343/702; 343/700 MS; 343/725; 455/90

(58) Field of Search ..... 343/700 MS, 702, 343/795, 715, 725, 806, 900, 901; 455/90, 129, 553

(56) References Cited

U.S. PATENT DOCUMENTS 4,571,595 A * 2/1986 Phillips et al. ..... 343/702
4,868,576 A * 9/1989 Johnson, Jr. ..... 343/702
6,239,765 B1 * 5/2001 Johnson et al. ..... 343/702
6,388,626 B1 * 5/2002 Gamalielsson et al. ..... 343/700 MS
6,404,394 B1 * 6/2002 Hill ..... 343/700 MS
6,408,190 B1 * 6/2002 Ying ..... 343/700 MS

* cited by examiner

*Primary Examiner*—Tan Ho
(74) *Attorney, Agent, or Firm*—Dilworth & Barrese, LLP

(57) ABSTRACT

Disclosed are a built-in dual band antenna device and an operating method thereof in a mobile terminal. In the built-in antenna dual band antenna device, a built-in dual band antenna has a first conductive antenna pattern formed on a board extended from the upper side of a main PCB and a second conductive antenna pattern on a board extended at a right angle from the upper side of the main PCB. A whip antenna is connected to the built-in dual band antenna, and contained in the mobile terminal when the whip antenna is retracted. A whip antenna driver extends or retracts the whip antenna. A duplexer separates an RF signal received from the built-in dual band antenna from an RF signal to be transmitted to the built-in dual band antenna. A controller processes the RF signals received at and transmitted from the duplexer and controls the whip antenna driver to extend the whip antenna in a speech state or upon a call attempt from a user.

28 Claims, 24 Drawing Sheets

BUILT-IN DUAL BAND ANTENNA DEVICE AND OPERATING METHOD THEREOF IN A MOBILE TERMINAL

PRIORITY

This application claims priority to an application entitled "Built-In Dual Band Antenna Device and Operating Method Thereof in Mobile Terminal" filed in the Korean Industrial Property Office on Sep. 20, 2000 and assigned Serial No. 2000-55275, the contents of which are hereby incorporated by reference.

BACKGROUND OF THE INVENTION

1. Field of the Invention

The present invention relates generally to a mobile terminal, and in particular, to a built-in dual band antenna device and an operating method thereof in a mobile terminal.

2. Description of the Related Art

In general, an antenna device in a mobile terminal includes a helical antenna protruding outside the terminal and a whip antenna. The helical antenna operates when the whip antenna is retracted into the interior of the terminal and the whip antenna operates when the whip antenna is extended from the terminal.

The protrusion of the helical antenna outside the terminal with the interworking structure of the conventional extendable whip antenna and the helical antenna impedes diverse designing of the terminal along the miniaturization trend and decreases portability. Also, when a user inadvertently drops the terminal from a certain height, the helical antenna is susceptible to breakage. The protrusion of the helical antenna in one side of the terminal makes the configuration of terminal asymmetrical. The resulting asymmetry of a radiation pattern in a radio frequency band deteriorates directionality-related performance.

As terminals have recently been miniaturized, they are more likely to contact the bodies of users when carried or during a call. This body contact causes antenna characteristics different from those in free space, thereby deteriorating the whole performance of a terminal.

SUMMARY OF THE INVENTION

It is, therefore, an object of the present invention to provide a built-in dual band antenna device and an operating method thereof in a mobile terminal to overcome the problems of design limitations, low reliability, and inconvenience to mobile communication encountered with a conventional mobile terminal.

To achieve the above object, a built-in dual band antenna device and an operating method thereof in a mobile terminal are provided. In the built-in antenna dual band antenna device, a built-in dual band antenna has a first conductive antenna pattern formed on a board extended from the upper side of a main PCB and a second conductive antenna pattern on a board extended at a right angle from the upper side of the main PCB. A whip antenna is connected to the built-in dual band antenna, and contained in the mobile terminal when the whip antenna is retracted. A whip antenna driver extends or retracts the whip antenna. A duplexer separates an RF signal received from the built-in dual band antenna from an RF signal to be transmitted to the built-in dual band antenna. A controller processes the RF signals received at and transmitted from. the duplexer and controls the whip antenna driver to extend the whip antenna in a speech state or upon a call attempt from a user.

The method of operating the built-in dual band antenna and the whip antenna varies depending on whether the mobile terminal is in a speech state or an idle state. In an idle state, the built-in dual band antenna is connected to a duplexer and in the speech state, the whip antenna is connected to the duplexer and extended.

BRIEF DESCRIPTION OF THE DRAWINGS

The above and other objects, features and advantages of the present invention will become more apparent from the following detailed description when taken in conjunction with the accompanying drawings in which.

DESCRIPTION OF THE PREFERRED EMBODIMENTS

Preferred embodiments of the present invention will be described hereinbelow with reference to the accompanying drawings. In the following description, well-known functions or constructions are not described in detail since they would obscure the invention in unnecessary detail.

Figure 1:
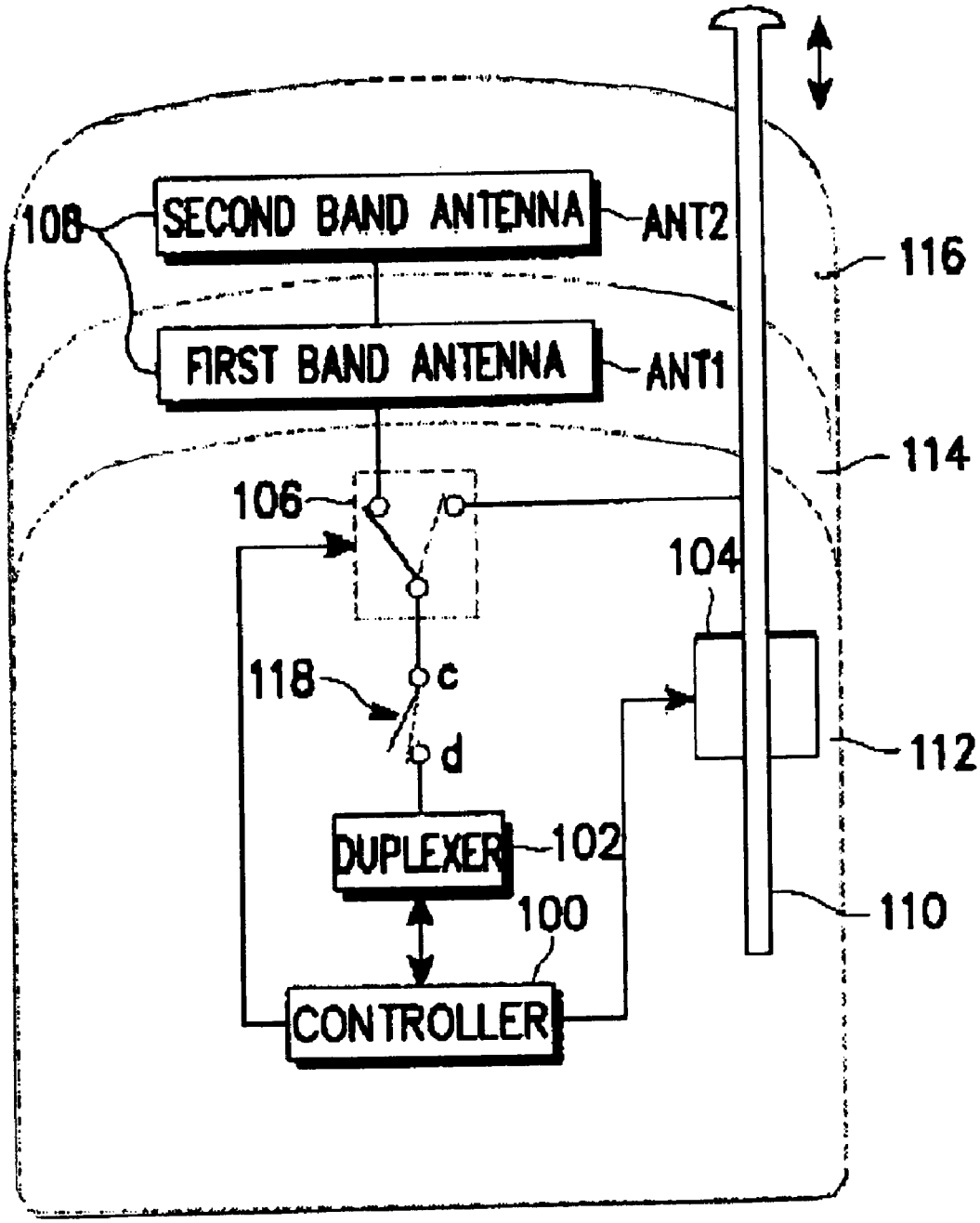
FIG. 1 is a block diagram of a built-in dual band antenna device according to an embodiment o the present invention.

FIG. 1 is a block diagram of a built-in dual band antenna device in a mobile terminal according to an embodiment of the present invention. Referring to FIG. 1, the built-in dual band antenna device is comprised of a built-in dual band antenna 108, an RF switch 106, a duplexer 102, a controller 100, a whip antenna driver 104, and a whip antenna 110. The built-in dual band antenna 108 includes a first band antenna ANT1 for a high frequency band that is formed into a meander line pattern on a board 114 extended from a main PCB (Printed Circuit Board) 112 and a second band antenna ANT2 for a low frequency band that is formed into a meander line pattern on a board 116 extended at a right angle from the upper side of the main PCB 112. The board 116 is used to secure the length of the low frequency band antenna. If both the antennas for two frequency bands are formed on the board 114, the board 114 must be extended long enough to form the antenna pattern therein, resulting in an increase in the size of the terminal.

The antennas for two frequency bands can be designed in diverse patterns. The first and second band antennas ANT1 and ANT2 are designed such that they have a feed point at the center of the main PCB 112. This prevents performance deterioration encountered in a mobile terminal with a conventional extendable antenna. As stated above, the problem is caused by an asymmetrical antenna radiation pattern in a high frequency band due to impossible central power feeding.

The whip antenna driver 104 moves the whip antenna 110 upward and downward by driving two driving rollers (not shown) at both sides of the whip antenna 110 under the control of the controller 100. The RF switch 106 switches the built-in dual band antenna 108 and the whip antenna 110 selectively to the duplexer 102 under the control of the controller 100.

The controller 100 provides overall control to the mobile terminal. According to the embodiment of the present invention, the controller 100 selectively connects the built-in dual band antenna 108 or the whip antenna 110 to the duplexer 102 by controlling the RF switch 106. During a call or when a user attempts a call by opening a flip for example, the controller 100 controls the whip antenna driver 104 to pull out the whip antenna 110 outside the terminal. As shown in FIG. 1, the built-in dual band antenna 108 is formed into meander line patterns on the boards 114 and 116 and the whip antenna 110 is automatically pulled out and retracted in the embodiment of the present invention.

Figure 2:
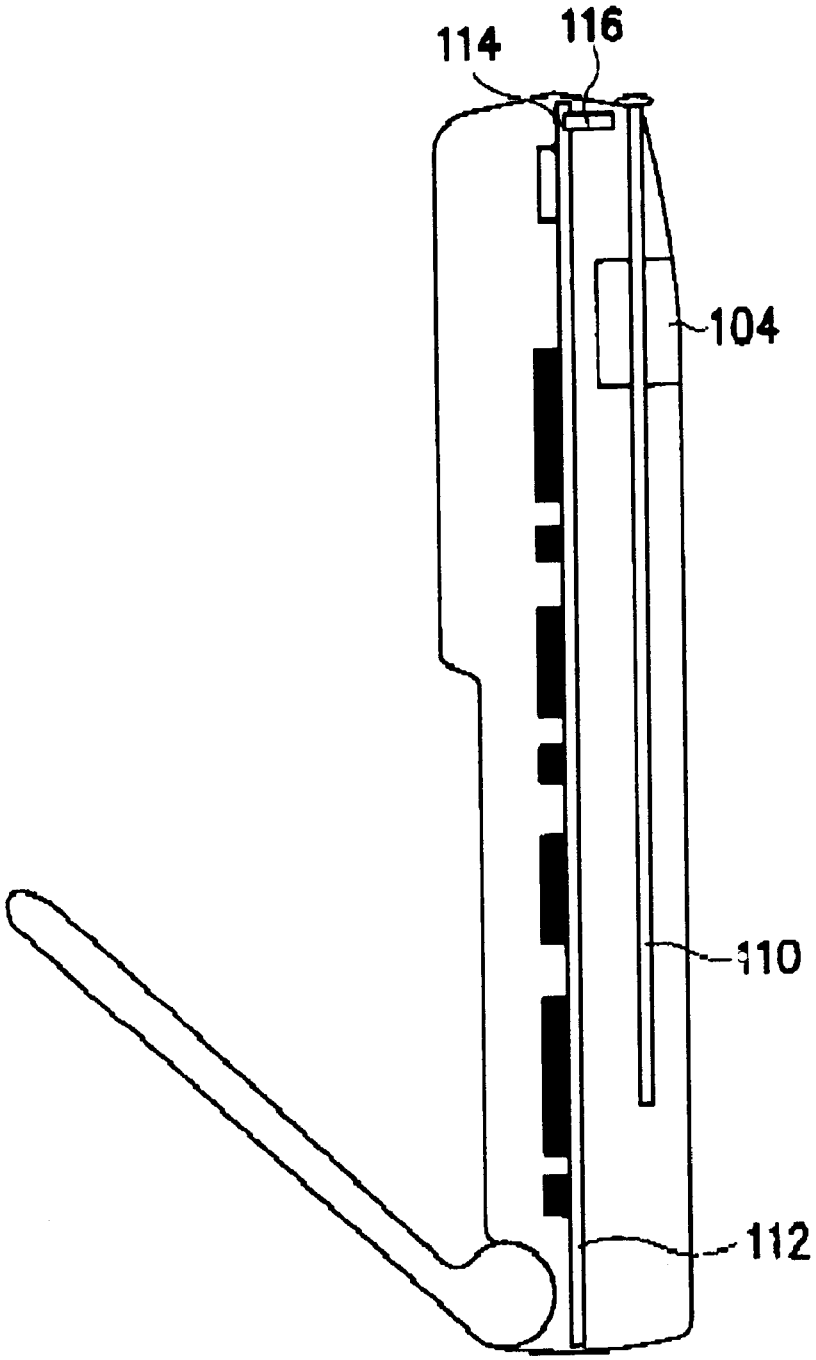
FIG. 2 is a side perspective view of the built-in dual band antenna device according to the embodiment of the present invention.

FIG. 2 is a side perspective view of a mobile terminal with the built-in dual band antenna shown in FIG. 1 according to the embodiment of the present invention. It is noted from FIG. 2 that the built-in dual band antenna 108 is readily formed on the board 114 extended from the upper side of the main PCB 112 and on the board 116 extended at the right angle from the upper side of the main PCB 112. The whip antenna 110 is usually contained in the terminal. During a call or when a user attempts a call, the whip antenna 110 is pulled out by the whip antenna driver 104, thereby ensuring portability.

In operation, the RF switch 106 switches an RF signal transmitted/received to/from the duplexer 102 to the built-in dual band antenna 108 or the whip antenna 110 under the control of the controller 100. The two antennas 108 and 110 operate independently. In an idle state or when an earphone is used, the controller 100 controls the RF switch 106 to switch the built-in dual band antenna 108 to the duplexer 102. In a speech state, the controller 100 controls the RF switch 106 to switch the whip antenna 110 to the duplexer 102.

In the idle state, the controller 100 switches the RF switch 106 to the built-in dual band antenna 108 and turns on a passive switch 118, connecting terminals c and d, so that the built-in dual band antenna 108 is connected to the duplexer 102. When a call is incoming in this state and the user answers the call by opening the flip or pressing a speech button, or when the user attempts to originate a call by opening the flip, the controller 100 controls the whip antenna driver 104 to extend the whip antenna 110 outside the terminal and controls the RF switch 106 to establish a signal path between the whip antenna 110 and the duplexer 102. Therefore, the connection between the duplexer 102 and the built-in dual band antenna 108 is released and only the whip antenna 110 operates.

Figure 3:
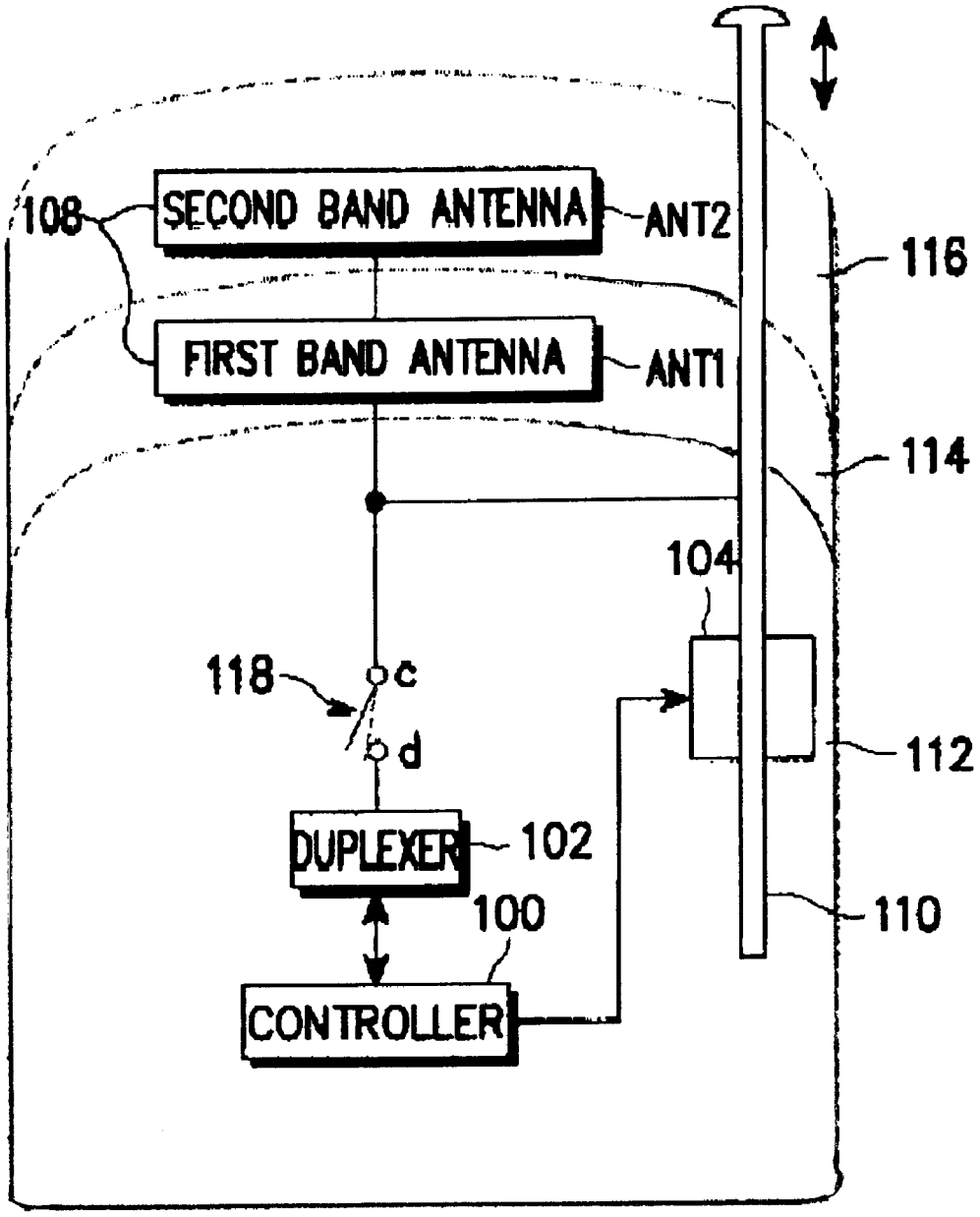
FIG. 3 is a block diagram of a built-in dual band antenna device according to another embodiment of the present invention.

While the built-in dual band antenna 108 and the whip antenna 110 are selectively connected to the duplexer 102 by the RF switch 106 in the embodiment of the present invention shown in FIG. 1, it can be contemplated that the built-in dual band antenna 108 is connected to the whip antenna 110 all the time as shown in FIG. 3. Also in this case, when the user opens the flip to answer an incoming call or to originate a call, the controller 100 controls the whip antenna driver 104 to pull out the whip antenna 110 to ensure stable signal reception through the whip antenna 110.

In conclusion, the built-in dual band antenna 108 operates while the whip antenna 110 is contained inside the terminal in an idle state, thereby ensuing terminal portability. On the other hand, the whip antenna 110 operates during a call, thereby improving RF signal reception characteristics and thus increasing communication quality. Meanwhile, if a test cable is inserted at a test point in an operation test state, the passive switch 118 is opened from the terminal d of the duplexer 102 and the RF switch 106 switches to the built-in dual band antenna 108, so that neither the whip antenna 110 nor the built-in dual band antenna 108 are connected to the duplexer 102.

Figure 4A:
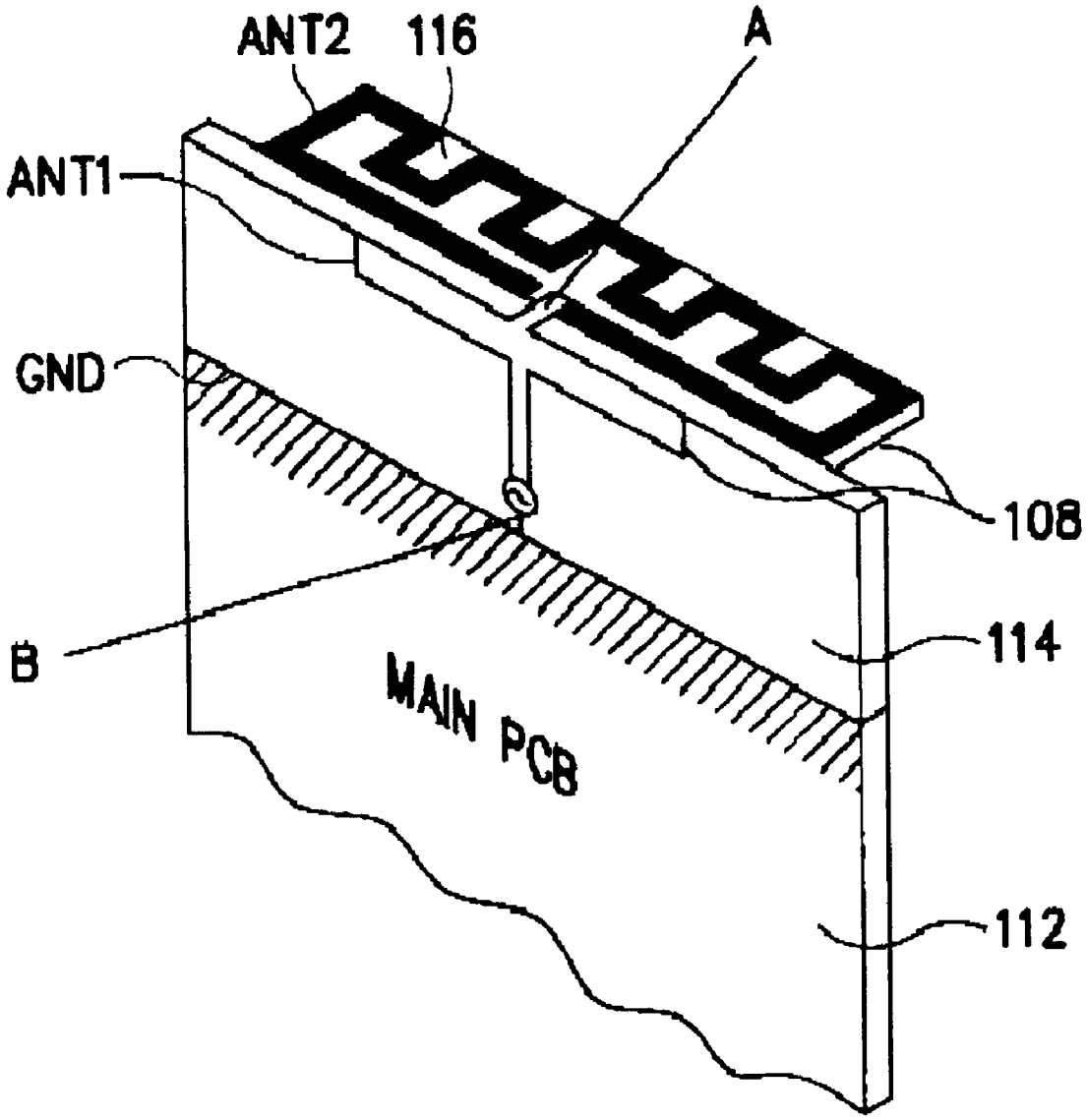
FIGS. 4A, 4B, and 4C illustrate the detailed structures of a built-in dual band antenna according to the present invention.
Figure 4B:
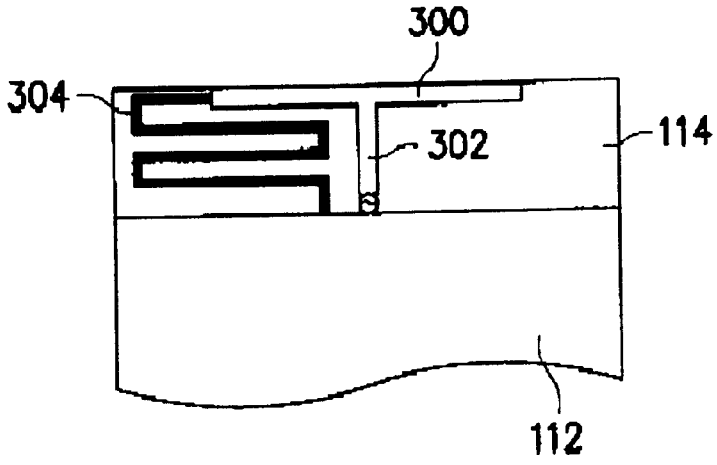
Figure 4C:
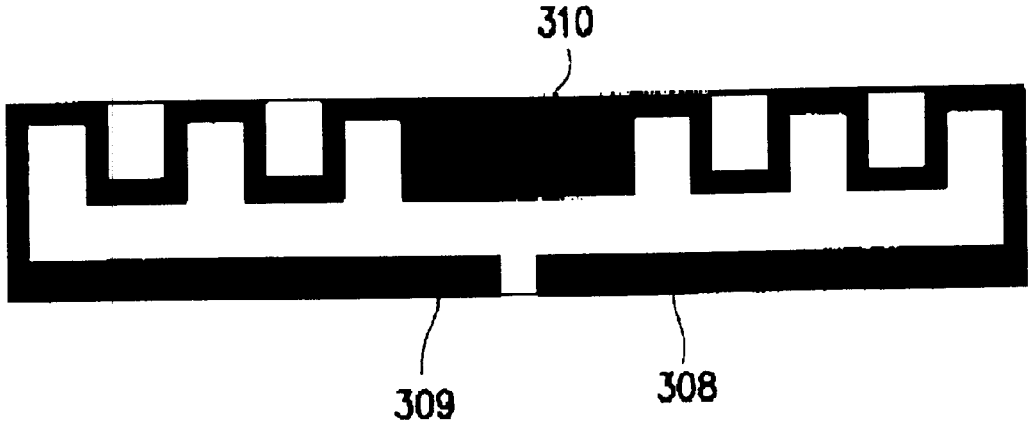

FIGS. 4A, 4B, and 4C are views illustrating a detailed structure of the built-in dual band antenna according to the embodiments of the present invention. Referring to FIG. 4A, the built-in dual band antenna 108 includes the high frequency band antenna ANT1 of a top loaded monopole type operating in a DCS band and the low frequency band antenna ANT2 of a zigzag type formed into a meander line pattern and operated in a GSM band. The DCS antenna ANT1 is formed on the board 114 extended from the upper. side of the main PCB 112 and the GSM antenna ANT2 on the board 116 extended at a right angle from the upper side of the main PCB 112. The two antennas are designed to be connected to each other by a line A and share one feed point B starting from under the DCS antenna ANT1.

FIG. 4B is a detailed view illustrating the DCS antenna ANT1. Referring to FIG. 4B, the DCS antenna ANT1 is largely divided into a vertical portion 302 and a horizontal portion 300. The horizontal portion 300 is horizontally symmetrical and disposed opposite to a ground line GND of the vertical portion 302. The horizontal portion 300 acts as a capacitive load for the vertical portion 302 and contributes to uniform current distribution, virtually extending the length of the antenna. Hence, it helps to achieve a wider bandwidth and a higher antenna gain. For better matching of the DCS antenna ANT1, a meander line pattern 304 can be formed to connect to the horizontal portion 300 as shown in FIG. 4B.

FIG. 4C is a detailed view illustrating the GMS antenna ANT2. Referring to FIG. 4C, the GSM antenna ANT2 is a zigzag type formed in a meander line pattern on the board 116, as stated above. The GSM antenna ANT2 is ¼ wavelength long. Since line portions 308 and 309 of the GSM antenna ANT2 are nearer to the horizontal portion 300 of the DCS antenna ANT1 than a curved portion 310, coupling occurs between the line portions 308 and 309, and the horizontal portion 300. Adjusting the distance between the line portions 308 and 309 and the horizontal portion 300 can change input impedances of the GSM band and the DCS band. As the distance is increased, the resonance points of the two bands are further apart from each other and a transmission rate in the DCS band is twice as high than that in the GMS band. As the distance is decreased, the result is opposite to the foregoing. It is possible to change a resonant frequency by controlling the length of the GSM antenna ANT2 or the length of the horizontal portion 300 of the DCS antenna ANT1. Therefore, an intended antenna can be achieved by appropriately combining a coupling-caused resonance point change with a resonance point change caused by control of antenna length. This applies to all dual band antennas or triple band antennas of CDMA/US PCS as well as of GSM/DSC. In the embodiments of the present invention, the distance between the GSM antenna ANT2 and the ground line GND is limited to 6 mm. In this case, the real part of input impedance in a GSM/DCS antenna is below 50Ω and its imaginary part has a capacitive component. For optimal impedance matching, an L type matching circuit is constructed with inductors connected in series and capacitors connected in parallel in a feeding line.

Figure 5A:
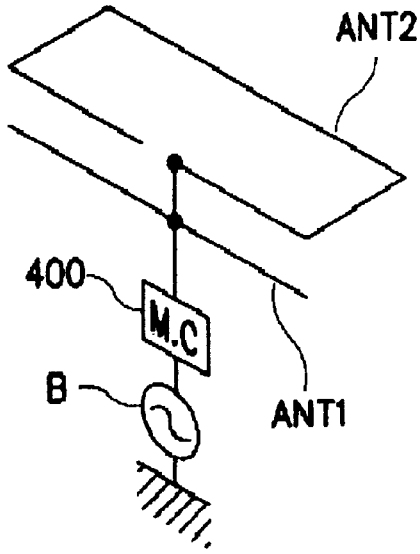
FIGS. 5A and 5B illustrate equivalent schematic circuits of the built-in dual band antenna shown in FIG. 4A.
Figure 5B:
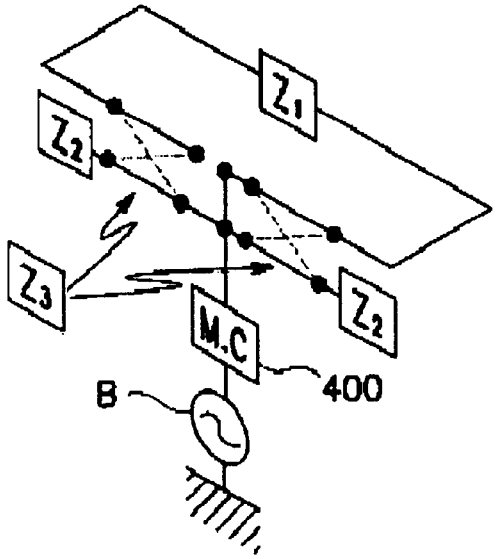

FIG. 5A is a schematic view of the built-in dual band antenna shown in FIG. 4A. FIG. 5B illustrates an equivalent circuit of the GSM/DCS dual band antenna according to the embodiments of the present invention. Referring to FIG. 4B, the total impedance Z of the DCS antenna ANT1 at the top load monopole type is calculated by $$Z_{total}=Z_{GSM}+Z_{DCS}Z_{mutual}+\eta Z_{whip} \quad (1)$$

and impedances $Z_1$, $Z_2$, and $Z_3$ at the respective points shown in FIG. 5B are $$Z_1=Z_{GSM},\ Z_2=Z_{DCs},\ Z_3=Z_{mutual} \quad (2)$$

The total impedance can be divided into the respective impedances of the DCS antenna ANT1 and the GSM antenna ANT2, impedance generated from coupling between the two antennas, a coupling coefficient η between a metal portion of the whip antenna 110 and the GSM antenna ANT2 when the whip antenna 110 operates in conjunction with the built-in dual band antenna 108, and the impedance of the whip antenna 110. The sum of the above impedances is the total impedance of the DCS antenna ANT1. This implies that as the coupling coefficient η is greater, more coupling occurs between the whip antenna 110 and the built-in dual band antenna 108. Therefore, the coupling coefficient η should be small.

The built-in antenna 108 and the whip antenna 110 can operate adaptively to situations. First, the feeding line is connected to the built-in dual band antenna 108 in an idle state and to the whip antenna 110 in a speech state by the use of a switch. In the case of a strong electric field in the speech state, the built-in dual band antenna 108 is still used.

A second method relies on coupling between the built-in dual band antenna 108 and the whip antenna 110. While the coupling between the built-in dual band antenna 108 and the whip antenna 110 must be avoided in the above switching method in order to prevent deterioration of antenna performance, power feeding from the built-in dual band antenna 108 to the whip antenna utilizing the coupling obviates the need for a switch. This power feeding is feasible as long as the coupling is controlled to have a minimal influence on an antenna matching state and an antenna radiation pattern.

Thirdly, a more apparent coupling feeding effect can be obtained by connecting a capacitor with low capacitance between the built-in dual band antenna 108 and the whip antenna 110. The latter two methods obviate the need for switches in mass production, thereby reducing product cost.

Figure 6A:
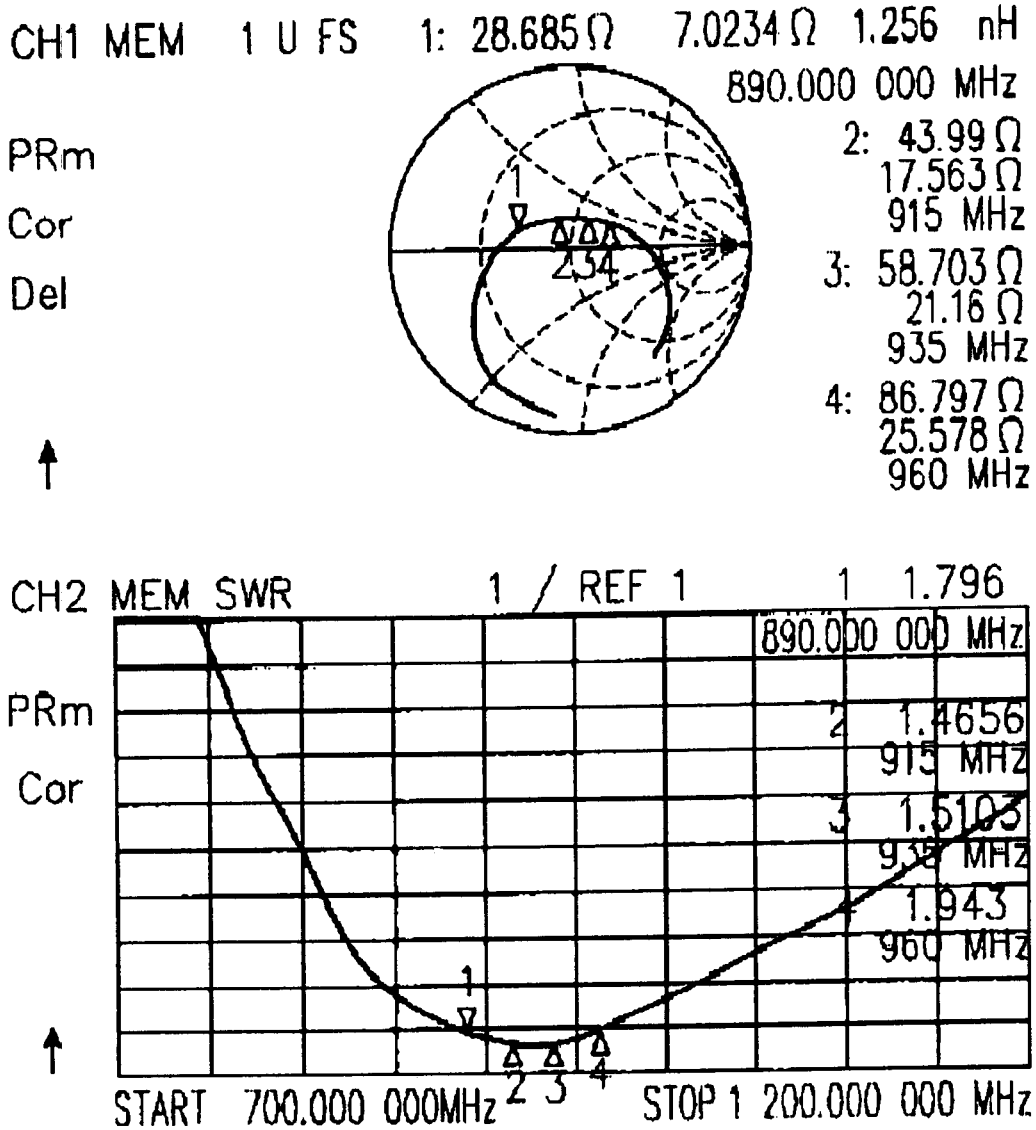
FIGS. 6*a* and 6*b* are graphs showing impedance matching states of a mobile terminal having the built-in dual band antenna according to the present invention.
Figure 6B:
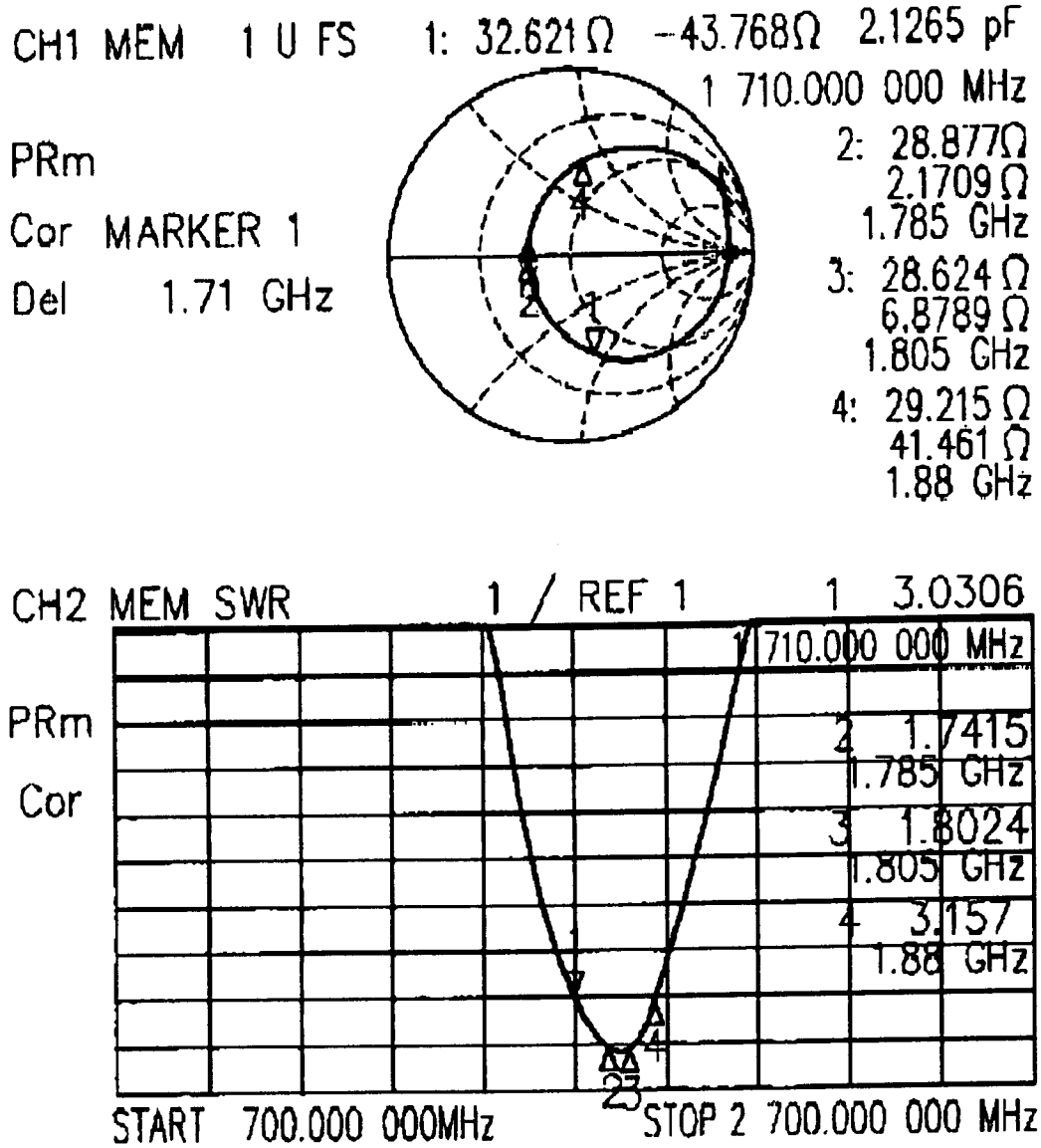

FIG. 6*a* is a graph showing an antenna impedance matching state when only the GSM antenna ANT2 operates in the built-in dual band antenna 108 and FIG. 6*b* is a graph showing an antenna impedance matching state when only the CS antenna ANT1 operates in the built-in dual antenna 108.

Figure 7A:
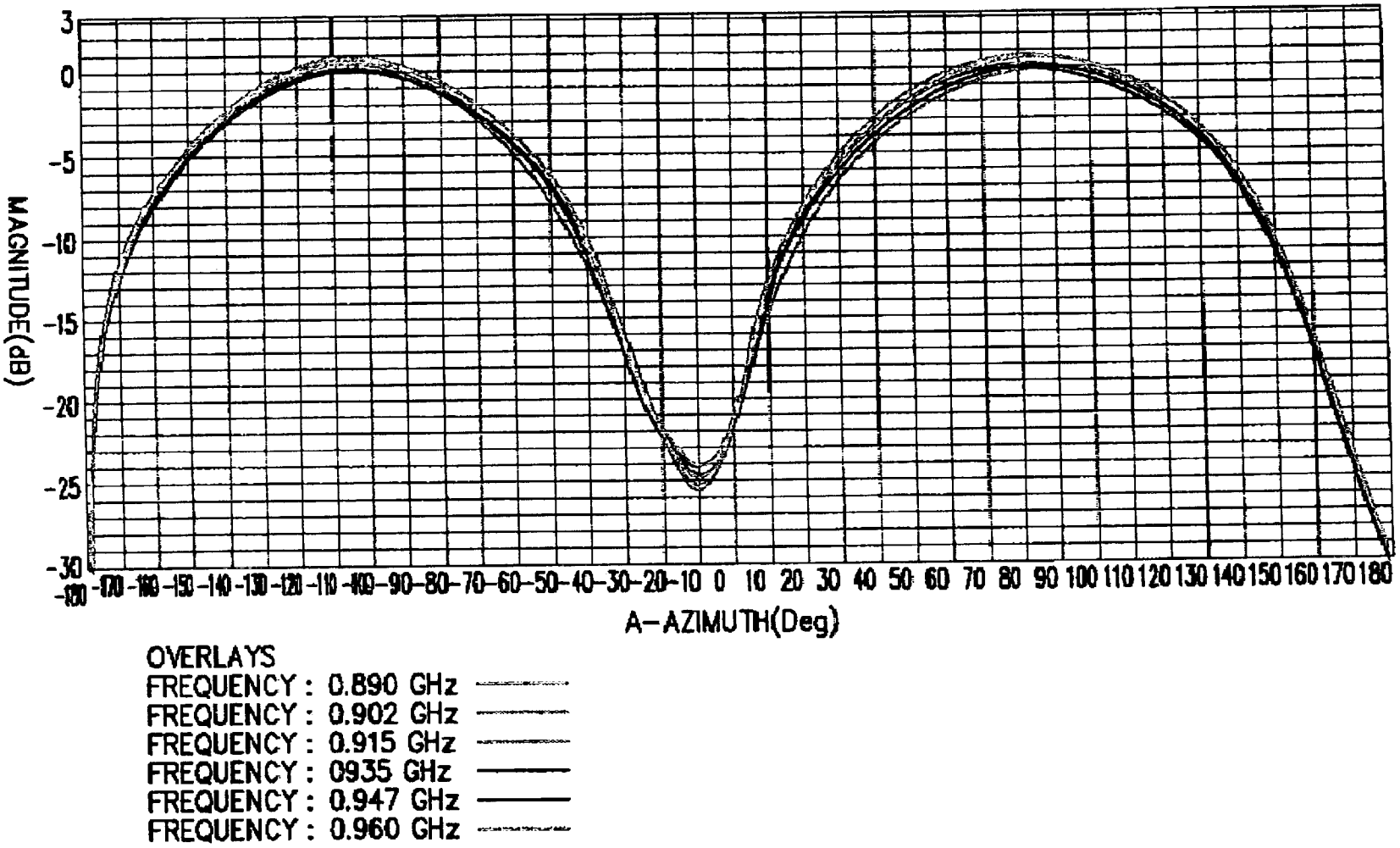
FIGS. 7*a* and 7*b* are graphs showing antenna radiation patterns of the mobile terminal having the built-in dual band antenna according to the present invention.
Figure 7B:
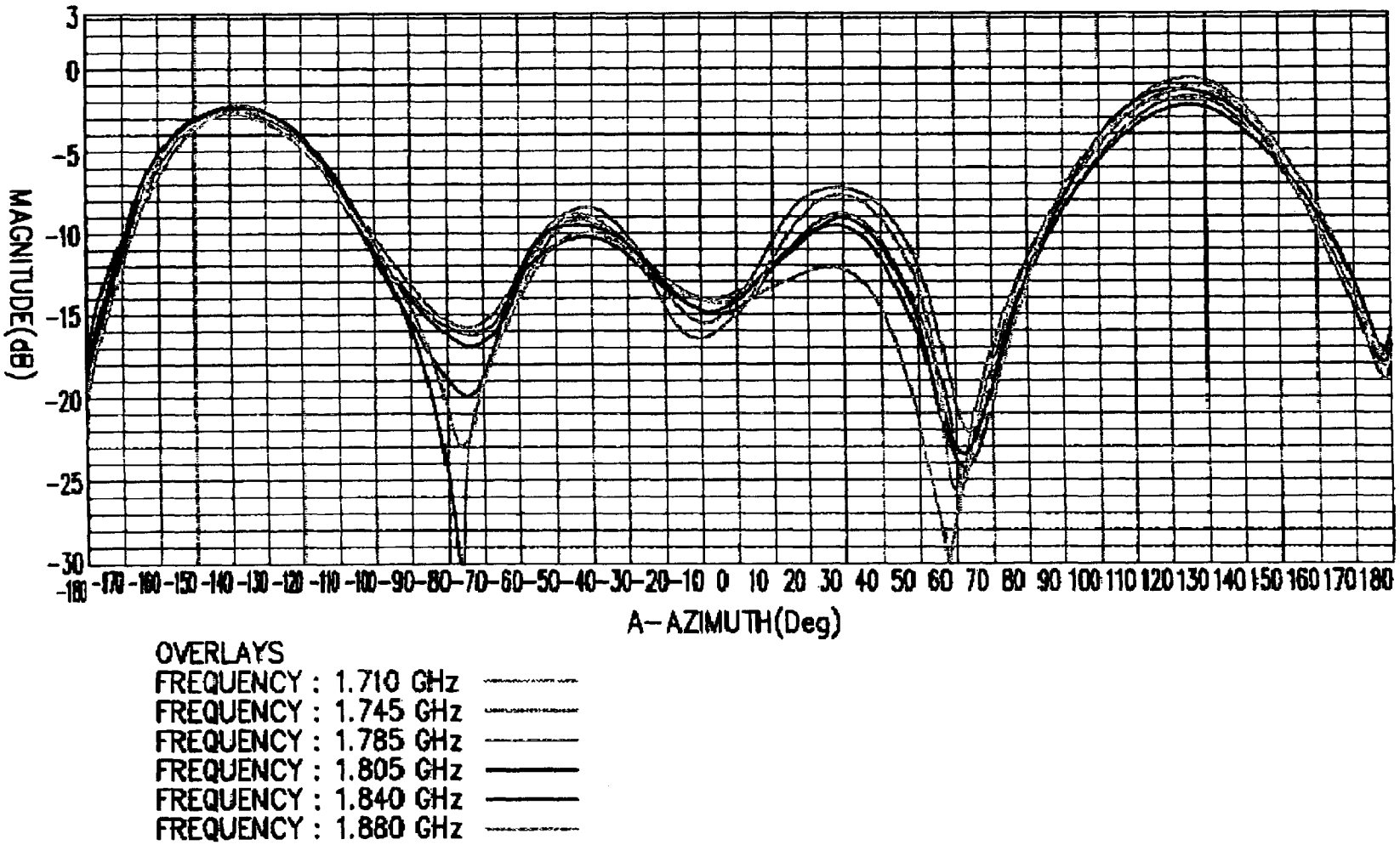

FIG. 7*a* is a graph showing an antenna radiation pattern when only the GSM antenna ANT2 operates in the built-in dual band antenna 108 and FIG. 7*b* is a graph showing an antenna radiation pattern when only the DCS antenna ANT1 operates in the built-in dual antenna 108.

Figure 8A:
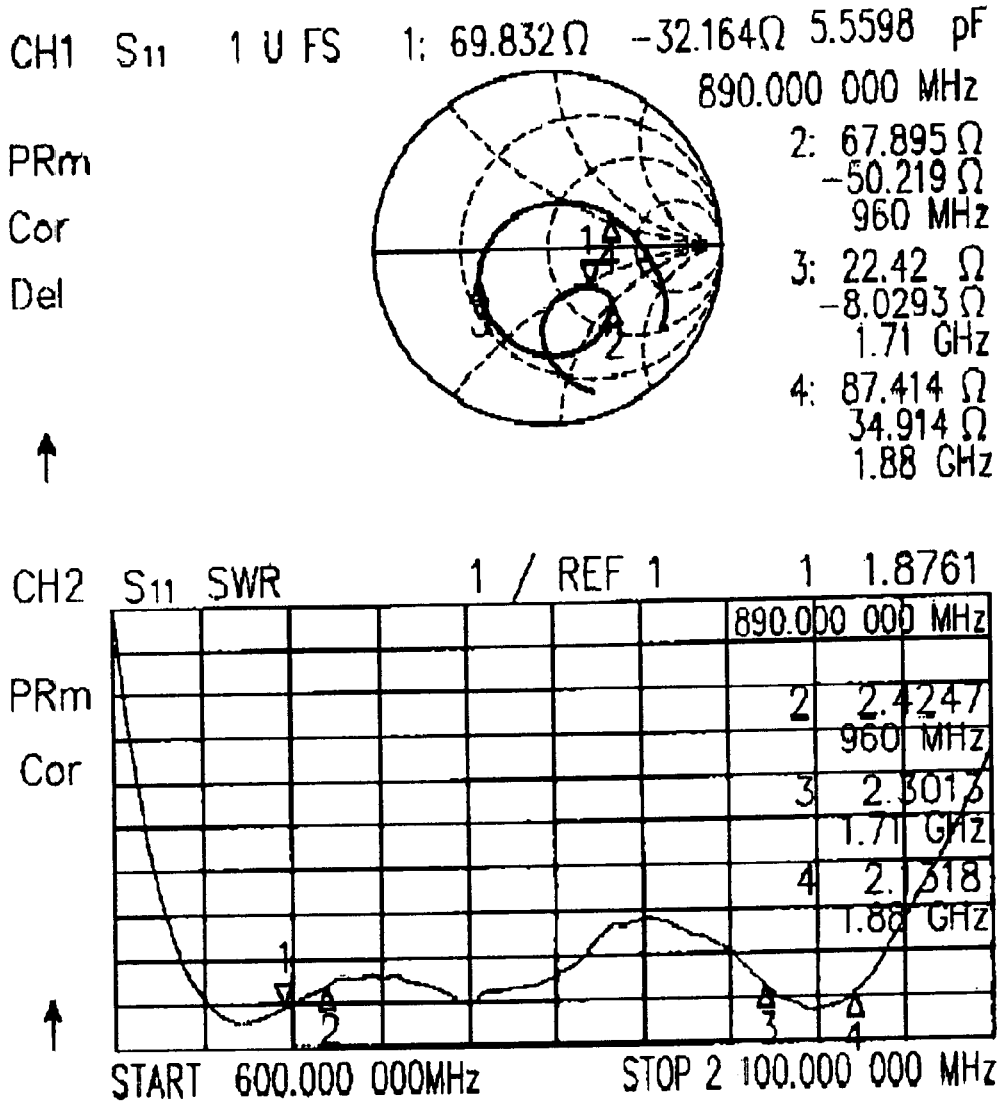
FIGS. 8*a* and 8*b* are graphs showing antenna impedance matching states according to the operation of a whip antenna in the mobile terminal having the built-in dual band antenna device according to the present invention.
Figure 8B:
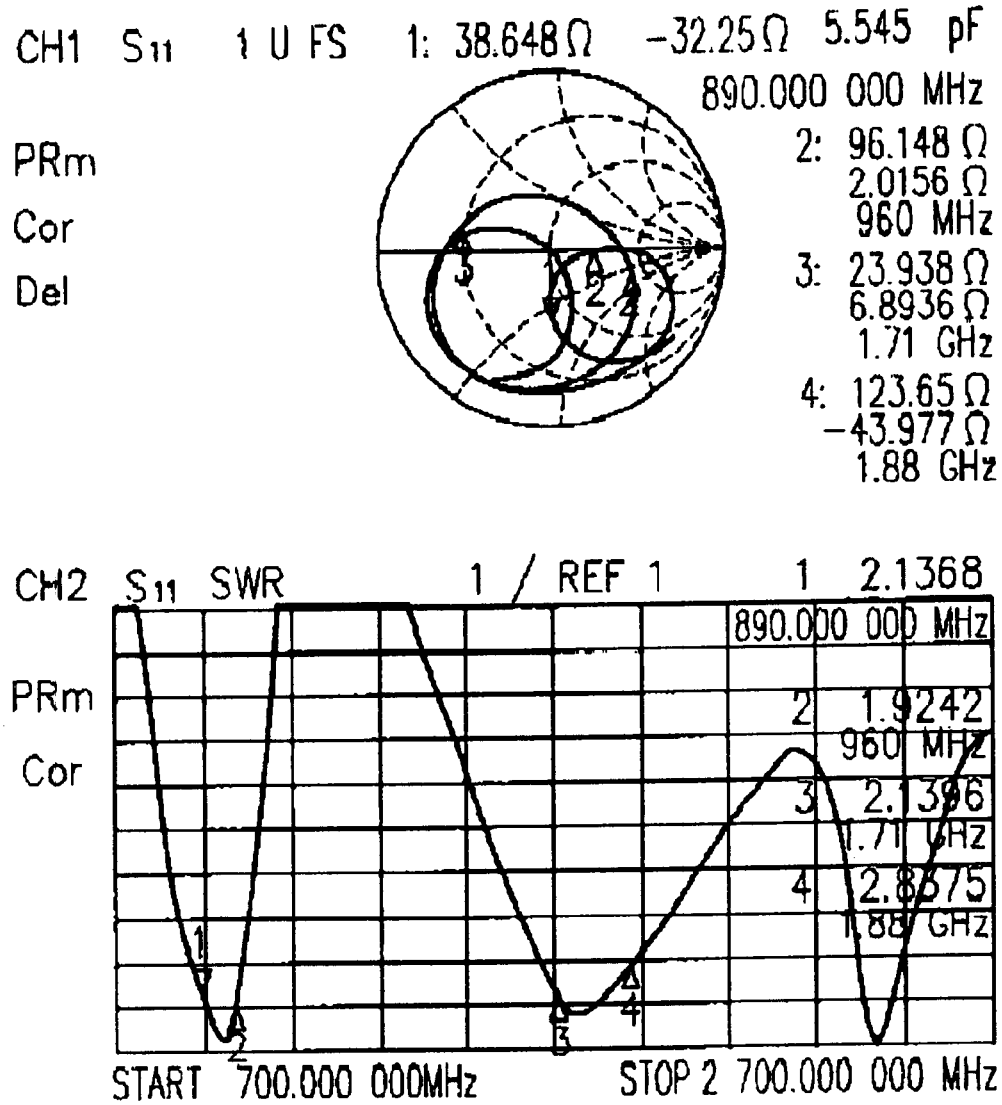

FIG. 8*a* is a graph showing an antenna impedance matching state when the whip antenna 110 operates while the built-in dual band antenna 108 is inoperative and FIG. 8*b* is a graph showing an antenna impedance matching state when the built-in dual band antenna 108 operates in conjunction with the whip antenna 110.

Figure 9A:
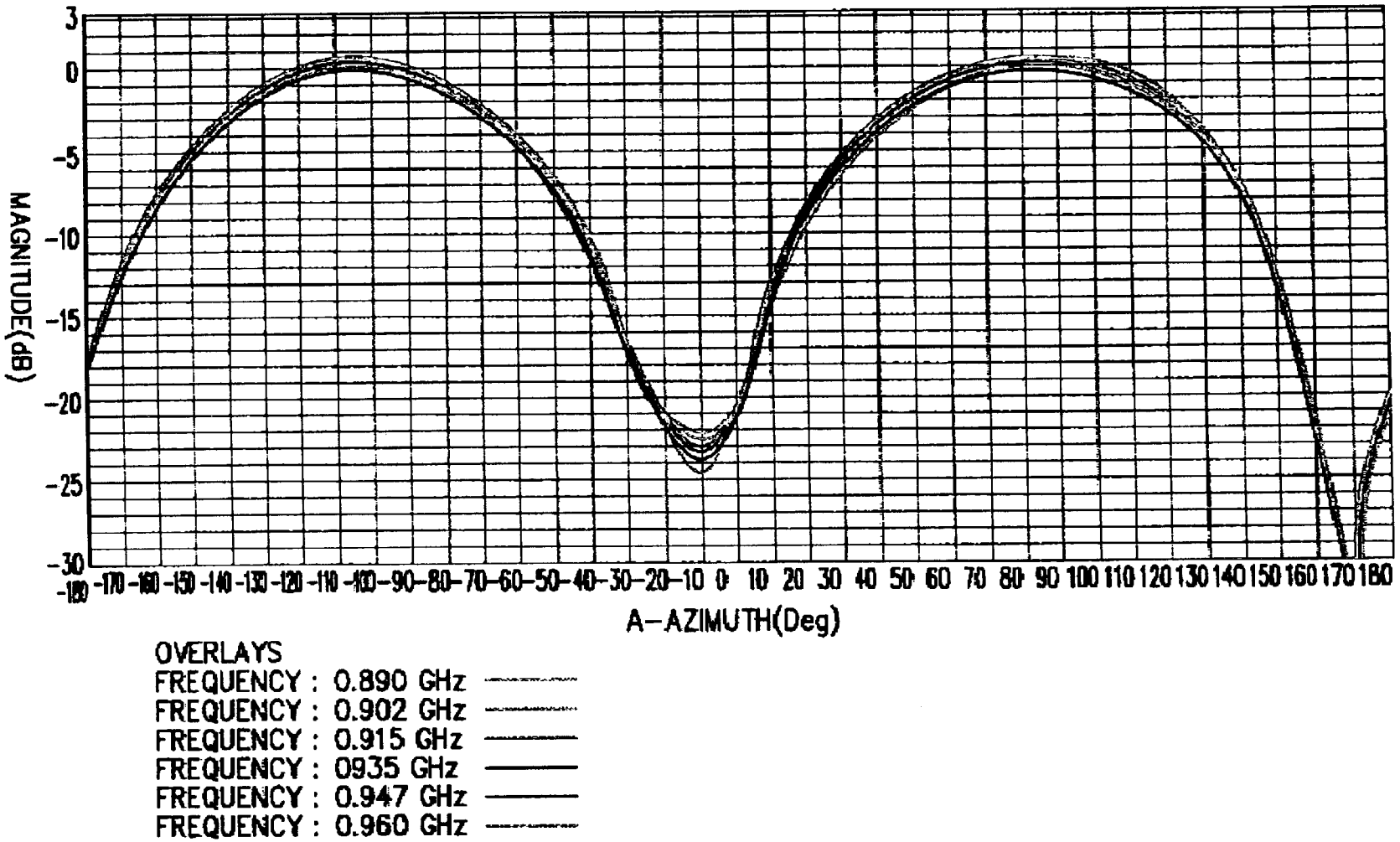
FIGS. 9*a* and 9*b* are graphs showing antenna radiation characteristics in a GSM (Global System for Mobile communication) band according to the operation of the whip antenna in the mobile terminal having the built-in dual band antenna device according to the present invention.
Figure 9B:
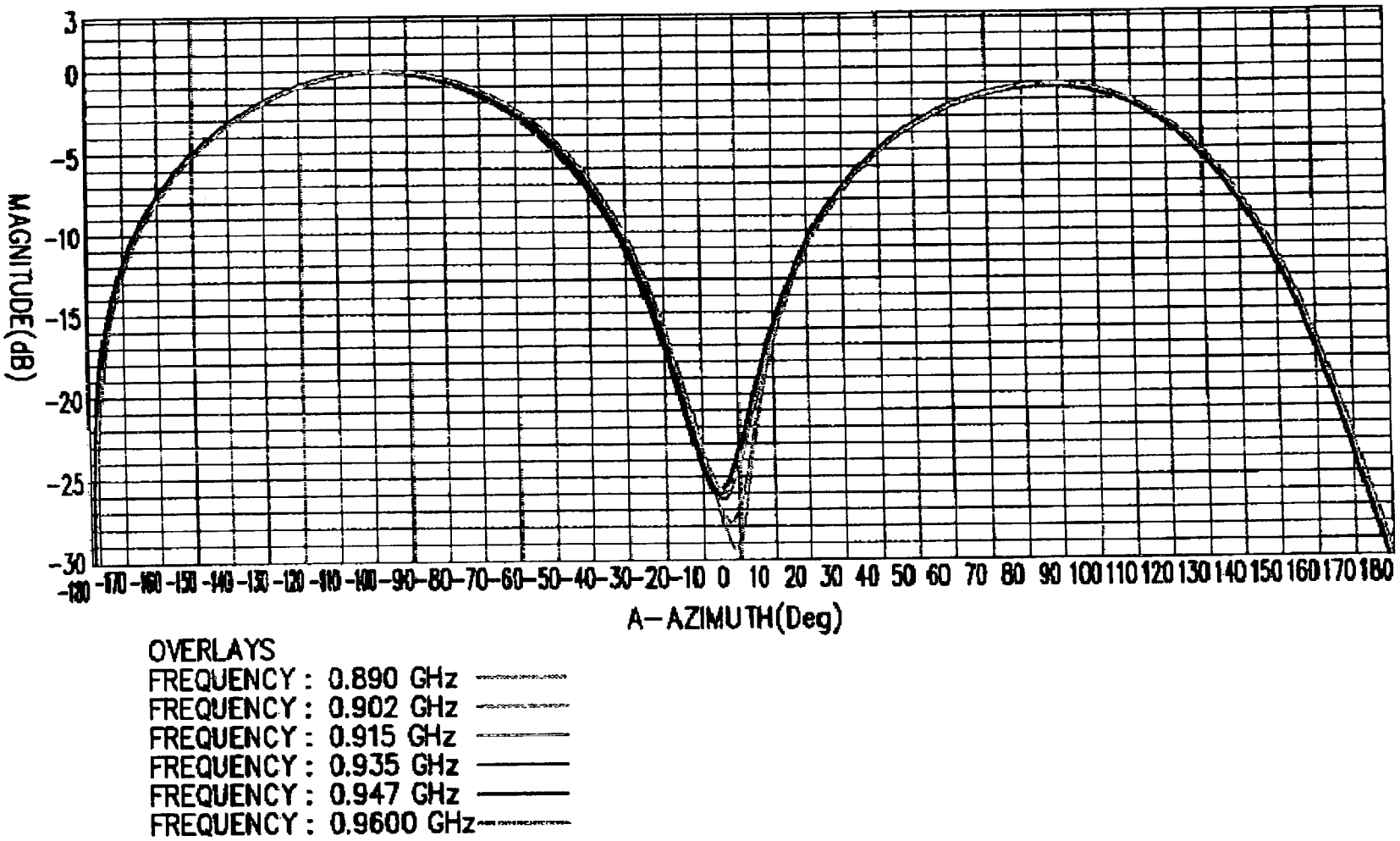

FIG. 9*a* is a graph showing an antenna radiation pattern in the GSM band when only the whip antenna 110 operates as in FIG. 8*a* and FIG. 9*b* is a graph showing an antenna radiation pattern in the GSM band when the built-in dual band antenna 108 operates in conjunction with the whip antenna 110 as in FIG. 8*b*.

Figure 10A:
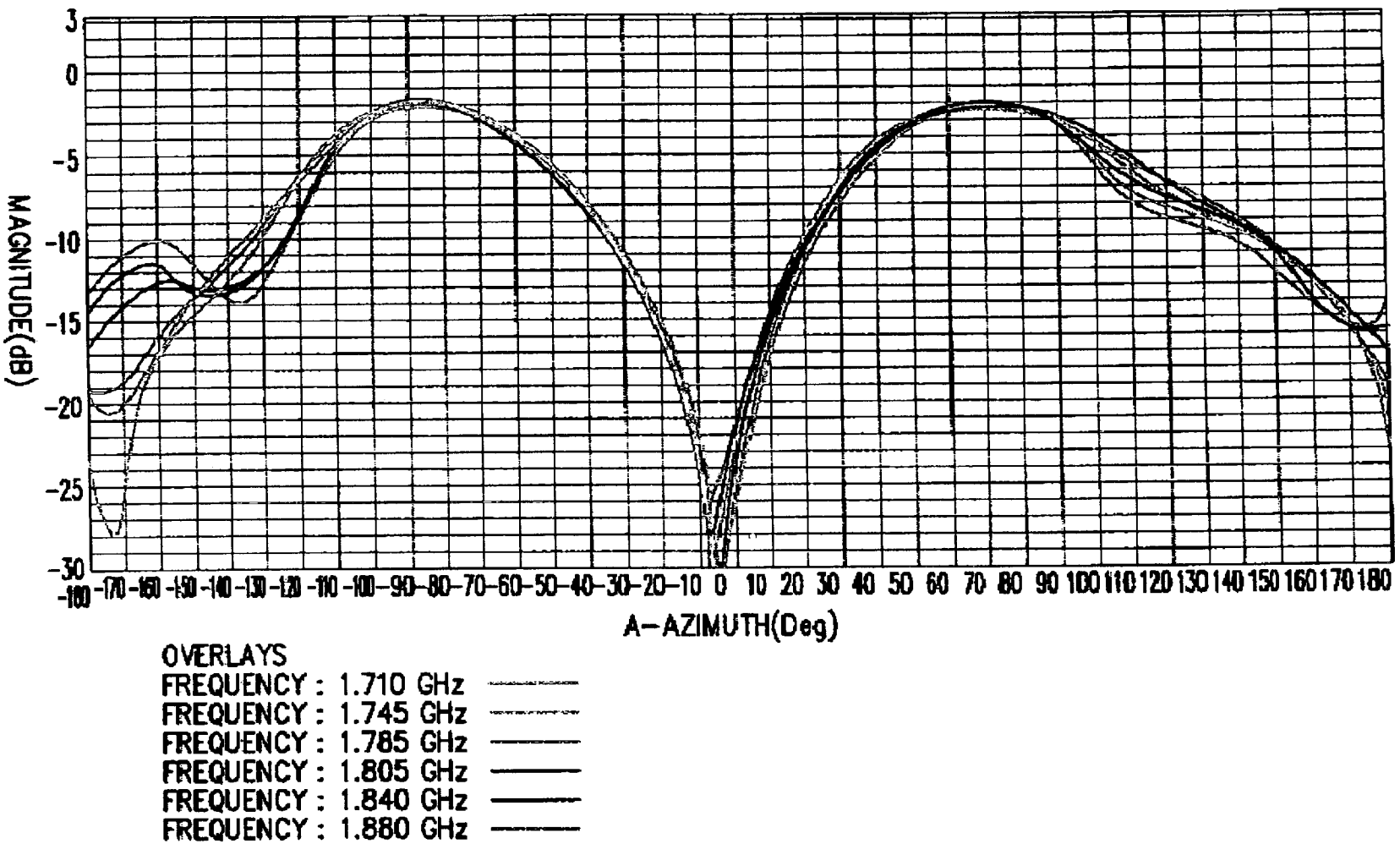
FIGS. 10*a* and 10*b* are graphs showing antenna radiation pattern characteristics in a DCS band according to the operation of the whip antenna according to the present invention.
Figure 10B:
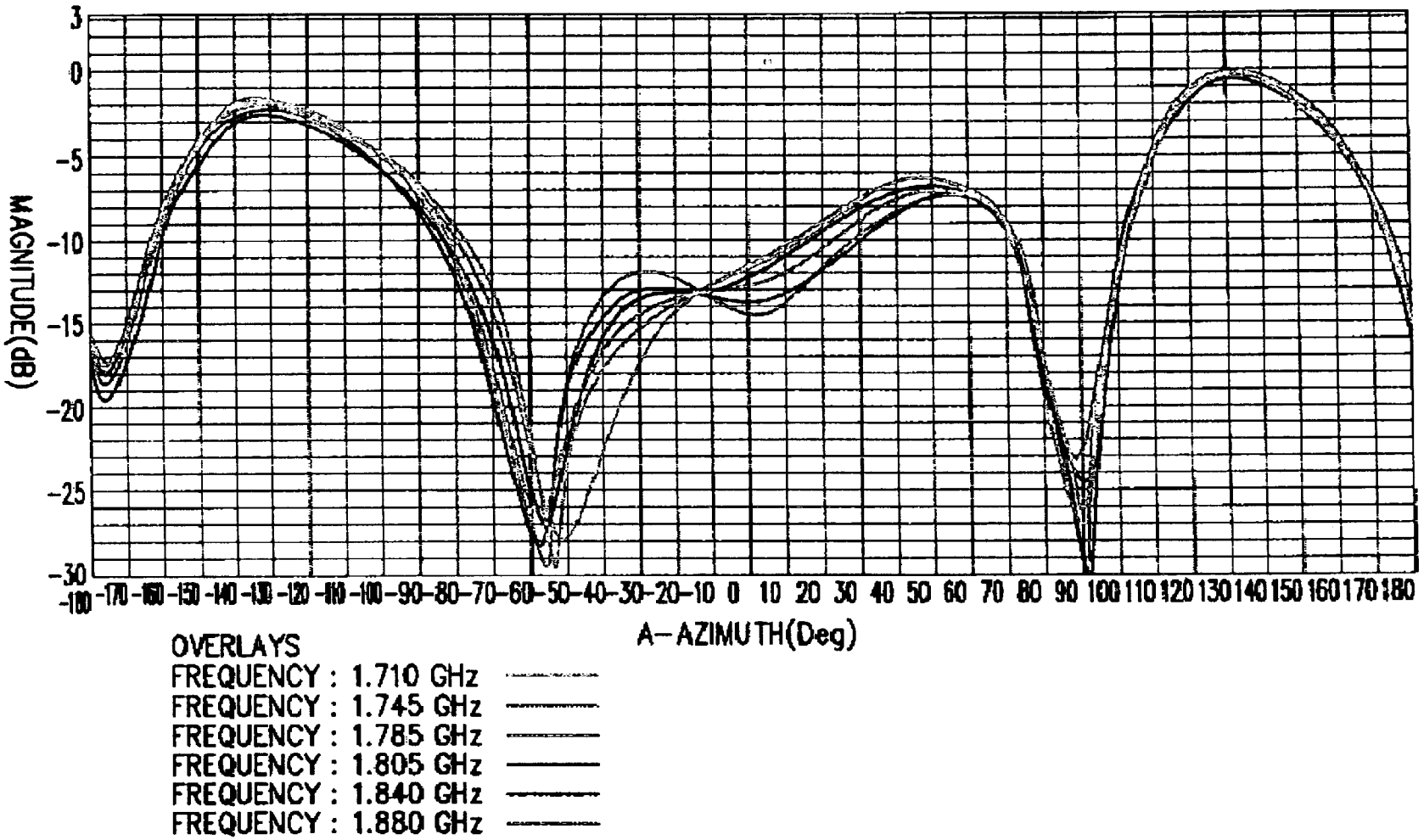

FIG. 10*a* is a graph showing an antenna radiation pattern in the DCS band when only the whip antenna 110 operates as in FIG. 8*a* and FIG. 10*b* is a graph showing an antenna radiation pattern in the DCS band when the built-in dual band antenna 108 operates in conjunction with the whip antenna 110 as in FIG. 8*b*.

Figure 11A:
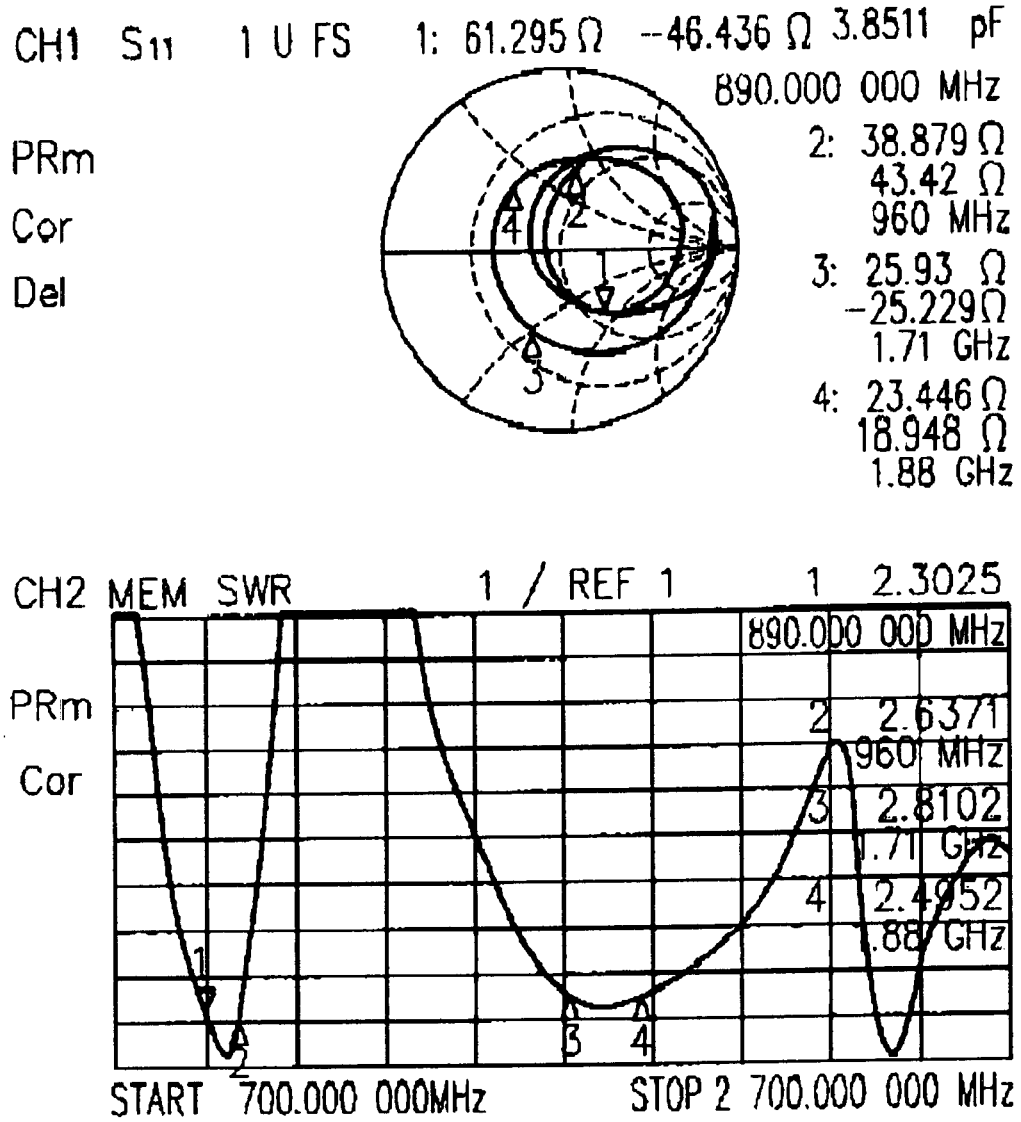
FIGS. 11*a* and 11*b* are graphs showing the antenna impedance matching state of the mobile terminal having the built-in dual band antenna according to the present invention and the antenna impedance matching state of a conventional mobile terminal having an extendable dual-band antenna.
Figure 11B:
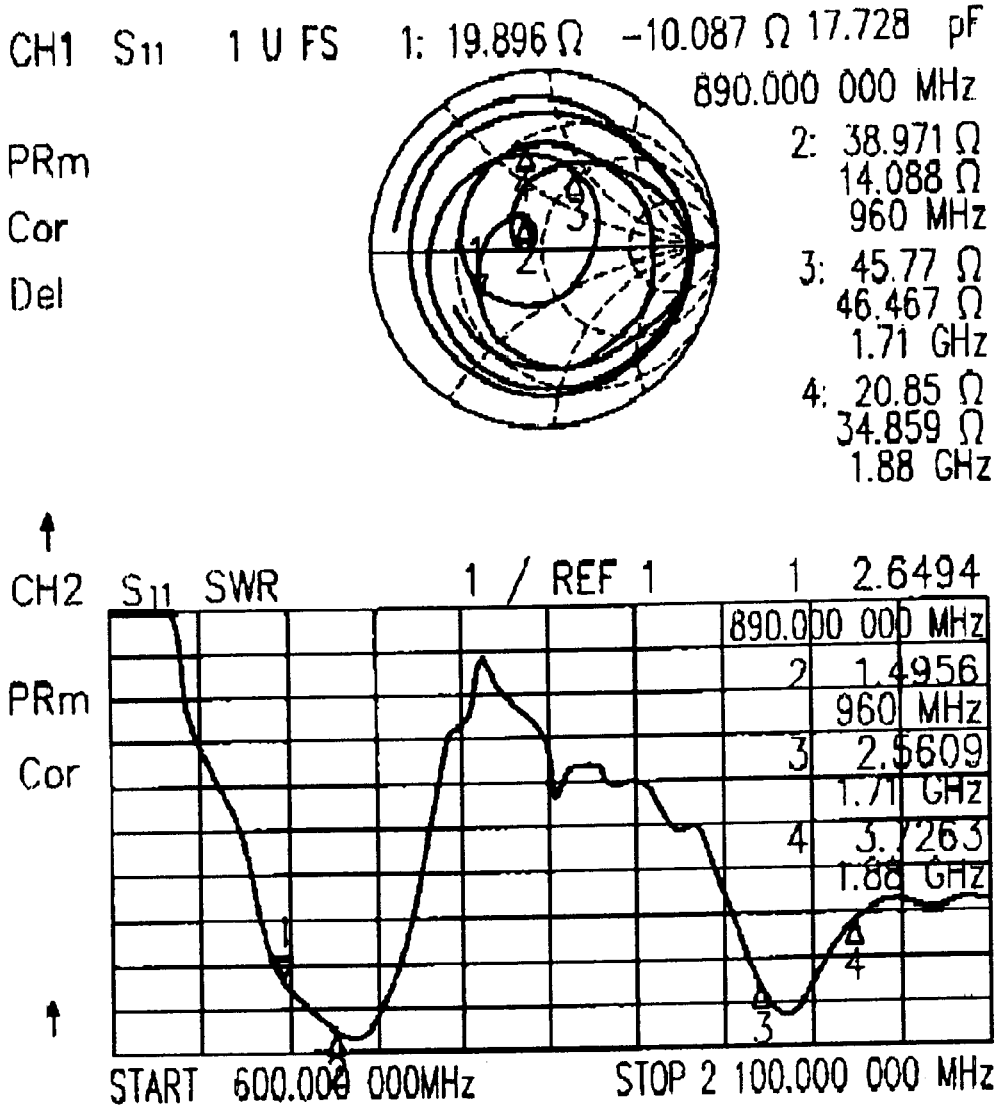

FIG. 11*a* is a graph showing an antenna impedance matching state in the mobile terminal having the built-in dual band antenna 108 when the GSM antenna ANT2 and the DCS antenna ANT1 operate together and FIG. 11*b* is a graph showing an antenna impedance matching state in a conventional mobile terminal having an extendable dual band antenna.

Figure 12A:
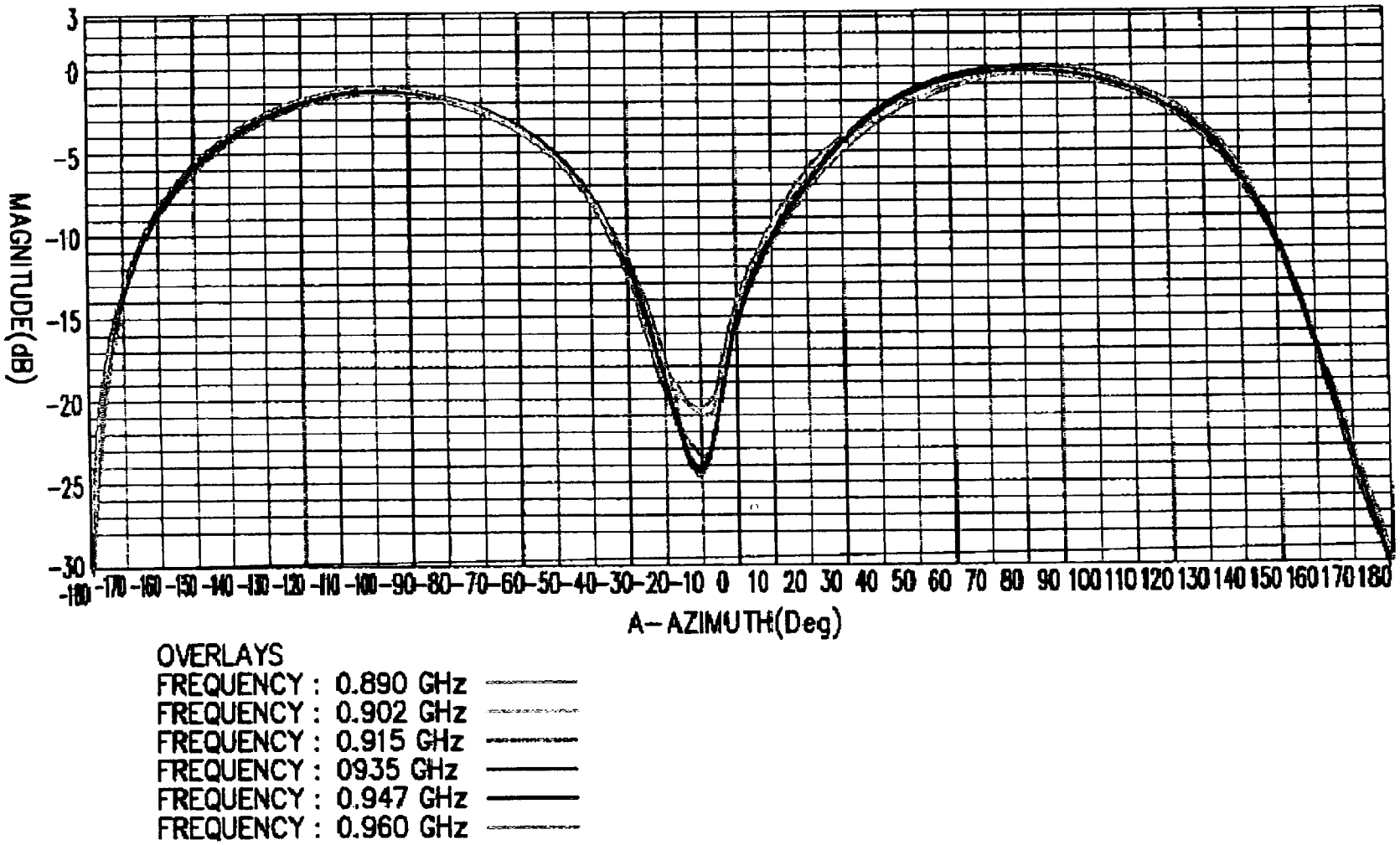
FIGS. 12*a* and 12*b* are graphs showing the antenna radiation pattern characteristic in the GSM band of the mobile terminal having the built-in dual band antenna according to the present invention and the antenna radiation pattern characteristic in the GSM band of the conventional mobile terminal having the extendable dual-band antenna when the whip antennas are contained in the terminals.
Figure 12B:
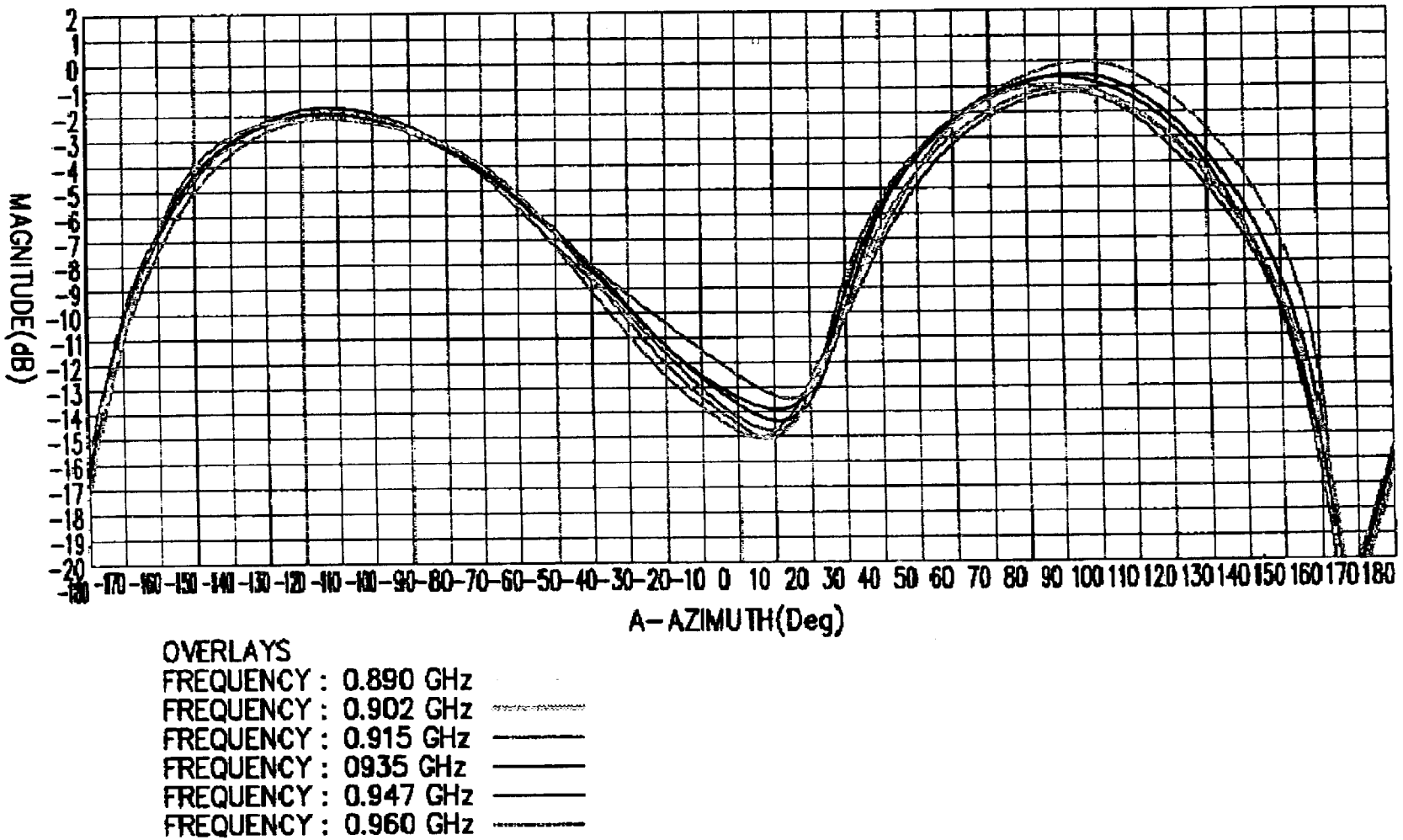

FIG. 12*a* is a graph showing an antenna radiation pattern in the GSM band of the mobile terminal having the built-in dual band antenna 108 when the whip antenna 110 is retracted and FIG. 12*b* is a graph showing an antenna radiation pattern in the GSM band of the conventional mobile terminal having the extendable dual band antenna when its whip antenna is retracted.

Figure 13A:
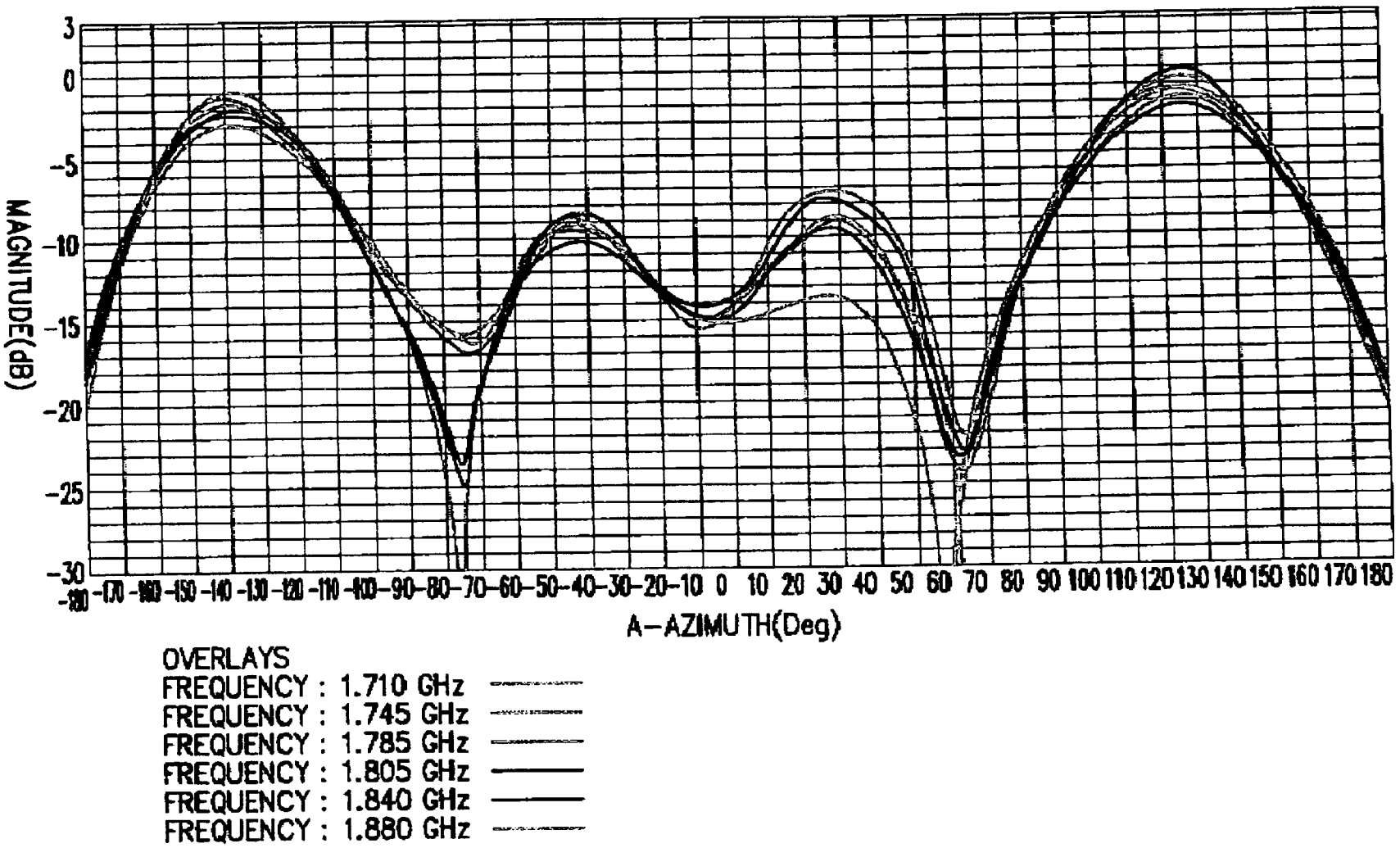
FIGS. 13*a* and 13*b* are graphs showing the antenna radiation pattern characteristic in the DCS band of the mobile terminal having the built-in dual band antenna according to the present invention and the antenna radiation pattern characteristic in the DCS band of the conventional mobile terminal having the extendable dual-band antenna when the whip antennas are contained in the terminals.
Figure 13B:
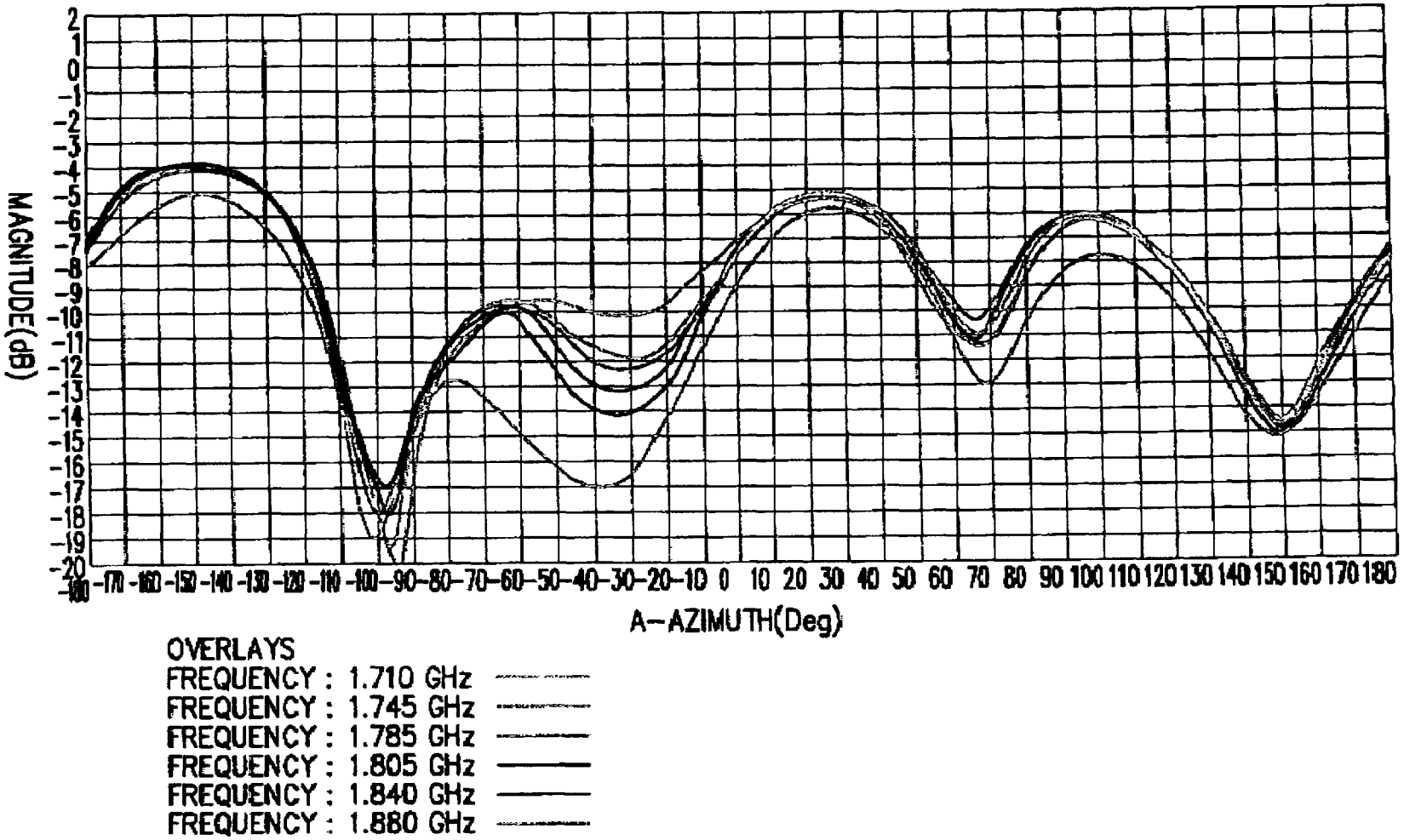

FIG. 13*a* is a graph showing an antenna radiation pattern in the DCS band of the mobile terminal having the built-in dual band antenna 108 when the whip antenna 110 is retracted and FIG. 13*b* is a graph showing an antenna radiation pattern in the DCS band of the conventional mobile terminal having the extendable dual band antenna when its whip antenna is retracted.

Figure 14A:
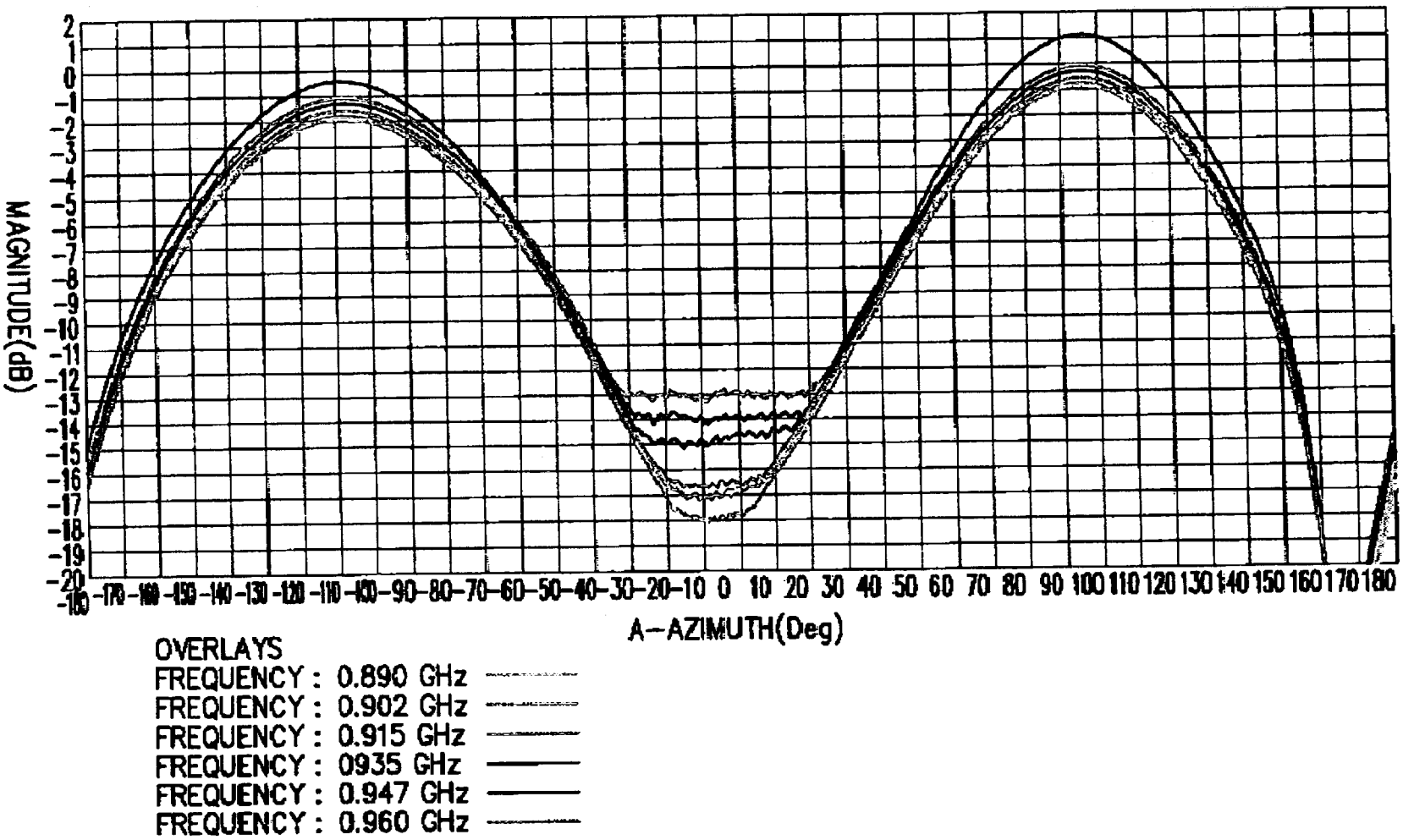
FIGS. 14*a* and 14*b* are graphs showing the antenna radiation pattern characteristics in the GSM band and the DCS band of the conventional mobile terminal having the extendable dual band antenna when its whip antenna is extended.
Figure 14B:
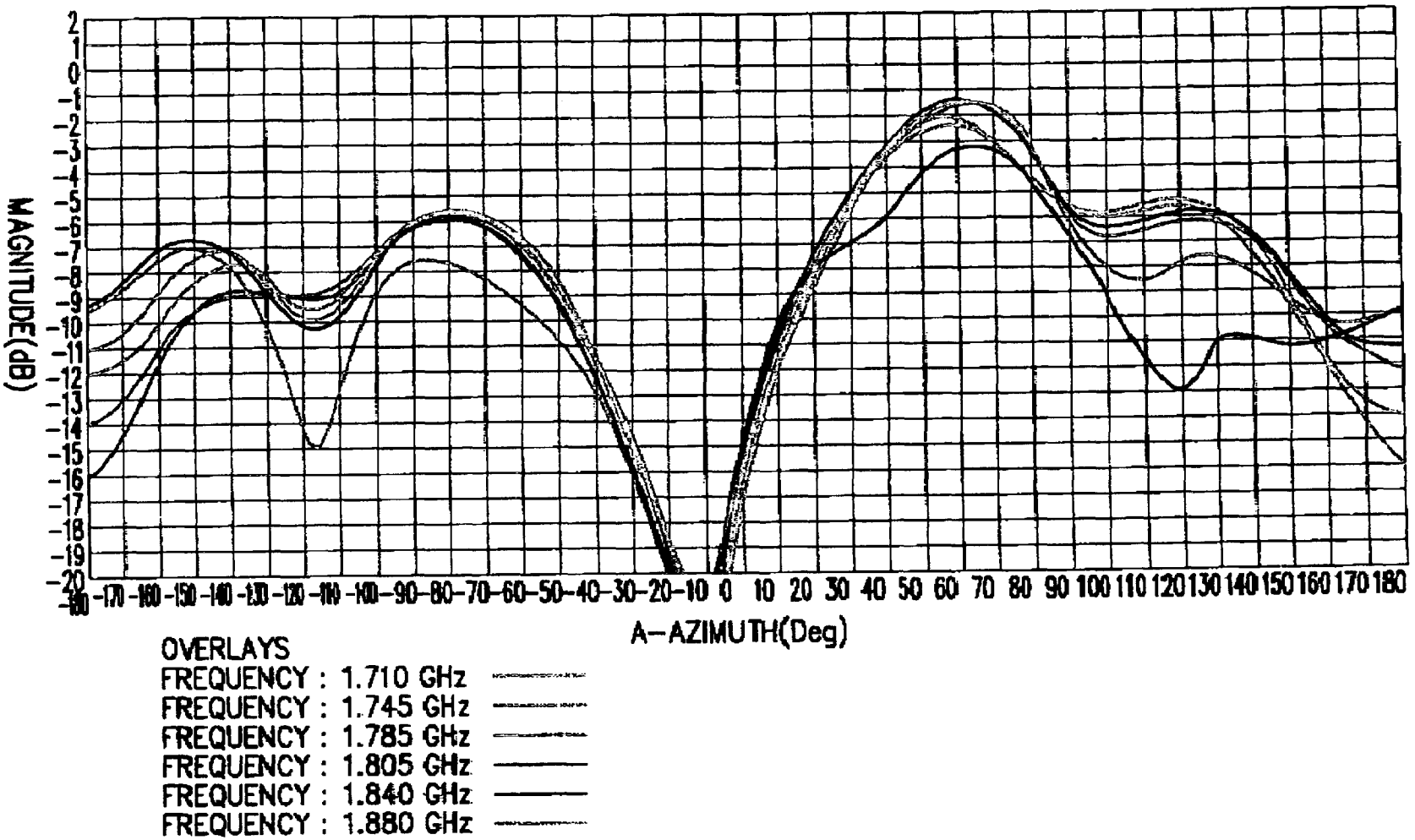

FIGS. 14*a* and 14*b* are graphs showing antenna radiation patterns in the GSM band and the DCS band, respectively of the conventional mobile terminal having the extendable dual band antenna when its whip antenna is extended.

As noted from FIGS. 6*a* to 14*b*, the antenna impedance matching states and antenna radiation pattern characteristics of the mobile terminal having the built-in dual band antenna according to the present invention are similar to or better than those of the conventional mobile terminal having the extendable dual band antenna. The mobile terminal according to the present invention shows better portability since it is free of a protruding antenna portion while it has the same communication quality as in the conventional mobile terminal.

While the built-in dual band antenna is connected to the duplexer in an idle state and if a user answers an incoming call by opening the flip or pressing a speech button or originates a call by opening the flip, the whip antenna is connected to the duplexer in the embodiments of the present invention, this is optional to the user. Though the antenna device of the present invention is basically configured such that the whip antenna is used in a speech state, a call can be conducted using the built-in dual band antenna without antenna switching if the user does not want to use the whip antenna. Also, automated retraction of a whip antenna can be set differently depending on the characteristics of a mobile terminal.

In addition, while the DCS antenna for a high frequency band is formed on the board extended from the upper side of the main PCB and the GSM antenna for a low frequency band is formed on the board extended at a right angle from the main PCB, this configuration can be modified according to the characteristics of a mobile terminal.

Therefore, it will be understood by those skilled in the art that various changes in form and details may be made therein without departing from the spirit and scope of the invention as defined by the appended claims.

What is claimed is:

1. A built-in dual band antenna device in a mobile terminal, comprising:

a built-in dual band antenna having first and second antennas for two frequency bands formed into different conductive patterns on boards extending from a side of a main printed circuit board (PCB);

a duplexer for separating a radio frequency (RF) signal received from the built-in dual band antenna from an RF signal to be transmitted to the built-in dual band antenna; and a controller for processing the RF signal directed from the built-in dual band antenna to the duplexer.

2. The built-in dual band antenna device of claim 1, wherein the first antenna of the built-in dual band antenna is formed into a first conductive antenna pattern on a board extended from an upper side of the main PCB and the second antenna is formed into a second conductive antenna pattern on a board extended at an angle from the main PCB.

3. The built-in dual band antenna device of claim 2, wherein the first conductive antenna pattern is a high frequency band antenna pattern for transmitting and receiving a high frequency signal and the second conductive antenna pattern is a low frequency band antenna pattern for transmitting and receiving a low frequency signal.

4. The built-in dual band antenna device of claim 3, wherein the high frequency antenna pattern is formed into a central feeding top load monopole type pattern on the board extended from the upper side of the main PCB.

5. The built-in dual band antenna device of claim 3, wherein the low frequency antenna pattern is formed into a zigzag type pattern on the board extended at a right angle from the upper side of the main PCB.

6. The built-in dual band antenna device of claim 5, wherein the low frequency antenna pattern is connected to a central feeding line of the high frequency band antenna pattern, for central feeding.

7. The built-in dual band antenna device of claim 3, wherein the high frequency band antenna pattern transmits and receives a PCS signal and a DCS signal in a high frequency band.

8. The built-in dual band antenna device of claim 3, wherein the low frequency band antenna pattern transmits and receives a CDMA signal and a GSM signal in a low frequency band.

9. The built-in dual band antenna device of claim 2, wherein the first conductive antenna pattern is a low frequency band antenna pattern for transmitting and receiving a low frequency signal and the second conductive antenna pattern is a high frequency band antenna pattern for transmitting and receiving a high frequency signal.

10. The built-in dual band antenna device of claim 9, wherein the high frequency band antenna pattern transmits and receives a PCS signal and a DCS signal in a high frequency band.

11. The built-in dual band antenna device of claim 9, wherein the low frequency band antenna pattern transmits and receives a CDMA signal and a GSM signal in a low frequency band.

12. A built-in dual band antenna device in a mobile terminal, comprising:

a built-in dual band antenna having first and second antennas for two frequency bands formed into different conductive patterns on boards extended from a side of a main PCB;

a whip antenna contained in the interior of the mobile terminal when the whip antenna is retracted;

a whip antenna driver for extending or retracting the whip antenna;

a duplexer for separating an RF signal received from the built-in dual band antenna from an RF signal to be transmitted to the built-in dual band antenna;

an RF switch for selectively switching the built-in dual band antenna and the whip antenna to the duplexer; and a controller for controlling the RF switch to switch the built-in dual band antenna or the whip antenna to the duplexer.

13. The built-in dual band antenna device of claim 12, wherein the first antenna of the built-in dual band antenna is formed into a first conductive antenna pattern on a board extended from an upper side of the main PCB and the second antenna is formed into a second conductive antenna pattern on a board extended at an angle from the main PCB.

14. The built-in dual band antenna device of claim 13, wherein the first conductive antenna pattern is a high frequency band antenna pattern for transmitting and receiving a high frequency signal and the second conductive antenna pattern is a low frequency band antenna pattern for transmitting and receiving a low frequency signal.

15. The built-in dual band antenna device of claim 14, wherein the high frequency antenna pattern is formed into a central feeding top load monopole type pattern on the board extended from the upper side of the main PCB.

16. The built-in dual band antenna device of claim 14, wherein the low frequency antenna pattern is formed into a zigzag type pattern on the board extended at a right angle from the upper side of the main PCB.

17. The built-in dual band antenna device of claim 16, wherein the low frequency antenna pattern is connected to a central feeding line of the high frequency band antenna pattern, for central feeding.

18. The built-in dual band antenna device of claim 14, wherein the high frequency band antenna pattern transmits and receives a PCS signal and a DCS signal in a high frequency band.

19. The built-in dual band antenna device of claim 14, wherein the low frequency band antenna pattern transmits and receives a CDMA signal and a GSM signal in a low frequency band.

20. The built-in dual band antenna device of claim 13, wherein the first conductive antenna pattern is a low frequency band antenna pattern for transmitting and receiving a low frequency signal and the second conductive antenna pattern is a high frequency band antenna pattern for transmitting and receiving a high frequency signal.

21. The built-in dual band antenna device of claim 20, wherein the high frequency band antenna pattern transmits and receives a PCS signal and a DCS signal in a high frequency band.

22. The built-in dual band antenna device of claim 20, wherein the low frequency band antenna pattern transmits and receives a CDMA signal and a GSM signal in a low frequency band.

23. The built-in dual band antenna device of claim 22, wherein the controller controls the whip antenna driver to extend the whip antenna connected to the duplexer outside the interior of the mobile terminal in the speech state or upon the call attempt from the user.

24. The built-in dual band antenna device of claim 12, wherein the controller controls the RF switch to switch the built-in dual band antenna to the duplexer in an idle state and to switch the whip antenna to the duplexer in a speech state or upon a call attempt from a user.

25. The built-in dual band antenna device of claim 12, wherein the whip antenna driver comprises:

two driving rollers in contact with the whip antenna; and a driving motor for rotating the driving rollers to extend or retract the whip antenna.

26. A built-in dual band antenna device in a mobile terminal, comprising:

a built-in dual band antenna having a first conductive antenna pattern formed on a board extended from an upper side of a main PCB and a second conductive antenna pattern on a board extended at a right angle from the upper side of the main PCB;

a whip antenna connected to the built-in dual band antenna, and contained in the mobile terminal when the whip antenna is retracted;

a whip antenna driver for extending or retracting the whip antenna;

a duplexer for separating an RF signal received from the built-in dual band antenna from an RF signal to be transmitted to the built-in dual band antenna; and a controller for processing the RF signals received at and transmitted from the duplexer and controlling the whip antenna driver to extend the whip antenna in a speech state or upon a call attempt from a user.

27. A method of operating a built-in dual band antenna and a whip antenna in a mobile terminal, comprising the steps of:

checking the state of the mobile terminal;

connecting the built-in dual band antenna to a duplexer in an idle state; and connecting the whip antenna to the duplexer and extending the whip antenna in a speech state.

28. The method of claim 27, further comprising the step of connecting the whip antenna to the duplexer when a user attempts to originate a call.

* * * * *